US005695075A

United States Patent [19]

Flum et al.

[11] Patent Number: 5,695,075

[45] Date of Patent: Dec. 9, 1997

[54] GRAVITY FEED PRODUCT MERCHANDISING DISPLAY DEVICE AND METHOD FOR MANUFACTURING THE SAME

[75] Inventors: Paul L. Flum, Ladue; Dewalt W. Fowler, Manchester; Keith Harbour, Florissant, all of Mo.

[73] Assignee: Paul Flum Ideas, Inc., St. Louis, Mo.

[21] Appl. No.: 629,533

[22] Filed: Apr. 9, 1996

[51] Int. Cl.[6] ..... A47F 7/00

[52] U.S. Cl. ..... 211/59.2; 211/74; 248/312; 312/72

[58] Field of Search ..... 211/59.2, 74, 162; 312/36, 72, 73; 248/312, 312.1

[56] References Cited

U.S. PATENT DOCUMENTS

| | | | |
|---|---|---|---|
| 2,620,691 | 12/1952 | Gould | 211/74 X |
| 2,919,814 | 1/1960 | Berkowitz | 211/74 |
| 3,243,220 | 3/1966 | Karas | 294/87.28 |
| 4,022,363 | 5/1977 | Eliassen | 211/74 X |
| 4,310,097 | 1/1982 | Merl | 211/74 X |
| 4,318,485 | 3/1982 | Clement | 211/59.2 |
| 4,325,486 | 4/1982 | Neal | 211/74 X |
| 4,367,818 | 1/1983 | Suttles | 211/74 X |
| 5,586,665 | 12/1996 | Brousseau | 211/59.2 |
| 5,586,687 | 12/1996 | Spamer et al. | 211/59.2 X |
| 5,595,310 | 1/1997 | Spamer et al. | 211/59.2 |

*Primary Examiner*—Robert W. Gibson, Jr.
*Attorney, Agent, or Firm*—Haverstock, Garrett & Roberts

[57] ABSTRACT

A gravity feed product merchandising display device for suspending a plurality of product containers in parallel rows therefrom, the display device comprising one or more adjacent product channels adaptable for receiving the cap or closure portion associated with a wide variety of product containers when positioned therewithin, each product channel including a pair of rail members for engaging the product containers positioned therebetween whereby the product containers are slidably movable therealong towards the front portion of the device for easy access and removal therefrom, and a stop member positioned adjacent the front portion of each product channel, the stop member including a generally forwardly facing aperture located in communication with each respective product channel, the stop member aperture being sized and shaped to engage the closure portion of the lead product container in each product channel so as to prevent its passage through the aperture when the product container is oriented in its suspended free state orientation but being sized and shaped so as to allow the closure portion of each product container to pass therethrough when the product container is angularly oriented at at least a minimum predetermined angle relative to its suspended free state orientation. The present invention also discloses several optional configurations and various components for accommodating product containers having differently sized neck and closure portions. Several methods for manufacturing the present display devices are also disclosed herein.

49 Claims, 11 Drawing Sheets

GRAVITY FEED PRODUCT MERCHANDISING DISPLAY DEVICE AND METHOD FOR MANUFACTURING THE SAME

The present invention relates generally to product merchandising and display devices of the gravity feed type and, more particularly, to several embodiments of a gravity feed display device wherein a plurality of product containers are suspended in one or more adjacent rows from tracks or rail members for slidable movement therealong towards the front portion of the device for easy access and removal therefrom. The present suspension type gravity feed product merchandising display devices include improved means to securely and safely arrest and/or stop the forward movement of each lead product container suspended from any particular product dispensing track while, at the same time, more prominently displaying the lead product container in each product track for better product visibility and customer recognition. The present stop means also affords a more convenient and more stable method for removing the product containers from the present devices as compared to known constructions. Additional means for enabling the present devices to be quickly and easily adapted for accommodating differently sized product containers are also disclosed herein.

BACKGROUND OF THE INVENTION

Gravity feed product merchandising display devices are popular among retailers and other merchandisers particularly for merchandising to consumers items such as bottled soft drink and fruit juice products in supermarkets, convenience stores, and other retail outlets. An important reason for the popularity of such gravity feed devices is that they enable the product containers displayed for sale therein to be successively advanced automatically towards the lower or forward end portion of the device as the forwardmost or endmost product containers in each product row are successively removed by consumers. This means that such gravity feed devices require less attention and maintenance since such devices are always attractively arranged and they require less time to restock when empty. Also, consumers like gravity feed devices because the products displayed therein are usually readily visible and within convenient reach.

In the past, the most successful of the known gravity feed merchandising devices for soft drink containers and the like have been shelf members wherein the product containers merchandised therefrom rest upon and are supported by inclined floor portions which guide such product containers to the front portion of the unit. Such shelf type gravity feed units typically utilize spaced upstanding divider members or wall portions which segregate the shelf members into discrete parallel channels for receiving, supporting and guiding products positioned therein such as soft drink or other product containers in parallel rows. However, in recent years, soft drink and fruit juice product containers have become increasingly larger, and particularly, taller. Unfortunately, these taller containers are generally more unstable when supported on the above-described gravity feed shelf members and these taller containers tend to fall over the divider walls into adjacent product channels thereby substantially hindering and disrupting the smooth gravity feed operation of such shelf members. This has led the industry to look to alternative constructions adaptable for gravity feed operation, particularly, devices of the present type whereby taller bottles can be suspended from their top or closure portions as compared to being supported from the bottom on a shelf floor.

In this regard, the known suspension type devices for bottles and other containers suffer from several shortcomings, the most important being the lack of ability of such devices to both securely arrest the forward advancement of the suspended bottles or containers in any particular row until such containers are removed therefrom and, at the time, provide good product visibility and easy access for consumers. Product visibility and access are increasingly important in today's highly competitive retail soft drink market as soft drinks are often selected and purchased by impulse at point-of-sale and other locations throughout a retail outlet. Anything that detracts from a product's attractiveness, visibility, or accessibility such as a bulky, obstructive, or difficult to use display device will tend to cause consumers to select a better displayed competitor's product. Known suspension type devices have also been found to be difficult to stock from the front or lowermost end which is an additional disadvantage from a merchandiser's perspective.

For example, U.S. Pat. No. 4,318,485 discloses a known suspension type gravity feed device which includes tiltable tracks for suspending a plurality of bottles therefrom in tandem by an annular flange associated with the neck portion of some product containers. Each track includes means to stop the forward movement of a row of bottles and hold the lead bottle for removal, which means include a stirrup member mounted forwardly of and below the lower or forwardmost end of the track. This stirrup member is adapted to receive and hold the bottom of the forwardmost bottle which drops into the stirrup from the track. Shortcomings of this construction include the relatively large size of the stirrups and the resultant tendency thereof to obscure and limit visibility of the bottom portion of the bottle held therein as well as the top portions of the bottles located therebehind. In addition, this stirrup feature is for the most part characterized by a complicated and somewhat cumbersome construction which includes multiple component parts; it is relatively large, bulky and awkward in operation; and it greatly increases the possibility that the lead bottle will either miss or fall out of the stirrup structure when being transferred from its corresponding track.

An alternative embodiment disclosed in U.S. Pat. No. 4,318,485 eliminates the use of the stirrup members and, instead, uses an upturned track segment located adjacent the forwardmost end of each track to provide a braking section for arresting and presenting the forwardmost bottle for removal. This construction provides better product visibility, however, it has been found that when a large number of bottles are suspended from any track, the forwardmost bottle can be urged or pushed up the upturned segment of the track by the weight of the other bottles resting thereagainst such that the forwardmost bottle can fall from the end of the track. The forwardmost bottles can likewise be easily dislodged from their respective upturned track portions by any bumping or other action which will cause the unit or tracks to move or vibrate such as consumers or shopping carts bumping into the overall unit. An attempted remedy to this problem utilizes a cam or lever member located between the tracks or rails to hold the second and successive bottles back such that those bottles do not exert a pushing force against the forwardmost bottle, which cam mechanism then releases the second bottle to slide into the forwardmost position when the first bottle is removed. This cam arrangement adds cost and more components to the overall unit and such mechanisms can become jammed or otherwise rendered inoperable due to contamination from liquids that can drip down onto them from broken or leaky bottles suspended thereabove. Furthermore, such cam or lever members usually require a bulky and unattractive housing and can substantially interfere with and even prevent easy restocking of the tracks from the front of the unit.

U.S. Pat. No. 3,243,220 discloses a known bottle carrier which utilizes spaced opposed flanges adapted for supporting therebetween a number of bottles by their neck portions. The flanges are curved upwardly at each end as in the previously discussed prior art construction to prevent accidental release of the bottles. A slot is provided at each end of the carrier adjacent to and above the curved portions of the flanges through which the endmost bottles can be removed from the carrier. To remove a bottle, it is pivoted or rotated into a position substantially parallel to the longitudinal axis of the carrier such that the bottle neck can be lifted upwardly through the slot. This carrier construction is not adaptable for gravity feed applications and, even if it were so adaptable, when the carrier is inclined towards one end to any significant degree, there is again the danger discussed above of the second and successive bottles forcing the endmost bottle upwardly and out of the carrier through the slot. Also, the upturned end portions of this carrier tend to obscure portions of the top and/or neck of the endmost bottles in each carrier row so as to make such bottles appear less attractive and less accessible.

Another problem that must be overcome when bottles or other product containers are to be suspended by their upper portions from any device is the non-uniformity among the various bottles or containers with which such gravity feed suspension devices are contemplated for use. For example, bottles such as the newer 20 oz. single serve bottles, and the one liter, two liter, and three liter multiple serve bottles currently utilized by most soft drink and fruit juice companies have cap or closure portions that can be 28 mm or 38 mm in outside diameter. To gain widespread commercial acceptance, any suspension type product merchandising display device for use with bottled soft drink and fruit juice products, as well as other bottled products, wherein differently sized containers are used must be adaptable to accommodate product containers having differently sized neck and closure portions.

SUMMARY OF THE INVENTION

The present invention overcomes many of the shortcomings and limitations associated with the known suspension type devices described above and teaches the construction, operation and method of manufacture of several embodiments of an improved suspension type display device which is specifically adapted for use in a gravity feed operation. The present devices include means to more securely and positively arrest and/or stop the forward movement of the bottles or other product containers suspended within each product row, while, at the same time, more prominently displaying and presenting the lead bottle or container in each product row for easy and convenient removal. Also, importantly, the present stop means as well as the other aspects of the present invention are readily and easily adaptable for use with bottles or product containers having differently sized neck and closure portions.

It is important to note that for the purposes of the present invention, the term "closure portion" is meant to include that portion of a bottle or other product container located above the neck portion. The closure portion of a particular bottle or container typically includes a cap, or closure lid member, and may also include an annular flange or other projection that extends outwardly around the neck portion of the container. This annular flange or lip can form a part of the bottle or container itself; it can be incorporated, in some fashion, into the cap or closure member itself; or other equivalent means can be utilized. Additionally, the cap or lid member can be of the screw on type, or of the older press-on or compression type. It is also recognized that a particular product container can likewise be suspended from the lower edge portion of the cap or lid member itself.

The display devices according to the present invention utilize at least one elongated product receiving track or channel having a pair of rail or runner members associated therewith located in spaced apart relationship so as to receive therebetween the neck portions of one or more bottles or other product containers for suspending such product containers by their closure portions for slidable movement therealong. The present devices are adapted to be supported using conventional means within existing product merchandising display equipment such as a multitude of different types of refrigerated display coolers, cold vaults, and other display applications commonly used for merchandising a wide variety of products such as soft drink and fruit juice products in supermarkets, convenience stores and the like. The present devices are mountable or suspendable within such existing coolers or other display units in spaced apart relationship one above the other such that each pair of product rail members are inclined downwardly towards the from of the display unit so as to allow the suspended bottles or other containers housed therewithin to slidably feed under the force of gravity one after the other towards the front of the device as the forwardmost or lead containers in each row is successively unloaded. When supported in the above-described manner for gravity feed operation, the bottles or other product containers typically have a generally vertical, or near vertical, free state orientation.

The present means to arrest and/or stop the forward movement of the product containers positioned in each product row as well as the present means to more attractively present the forwardmost product container for easy removal include a stop member positioned adjacent the forward end portion of each respective pair of rail members. The present stop member has a generally forwardly facing aperture or opening therethrough located in communication with the space defined between and above each respective pair of rail members or runners, which aperture is sized and shaped so as to receive the neck portion of each product container freely therethrough but further includes at least one peripheral edge portion forming such aperture which is positioned and located so as to engage at least a portion of the closure portion associated with the lead product container when positioned thereagainst. This peripheral engagement is sufficient to effectively arrest or stop forward movement of the lead and successive bottles or product containers in each respective row even when the present devices are stocked from the rear where newly inserted bottles or containers are sliding down the rail members towards the front of the devices. This peripheral engagement also, importantly, leaves the central region of the closure portion of the lead bottle or container largely attractively displayed through the aperture, the remainder of the lead product containers suspended within each product row being fully exposed and completely visible to the consumer.

In order to allow removal of the bottles or other containers positioned within each respective track or product channel, it is important that the forwardly facing aperture or opening associated with the present stop member be further sized and shaped so as to allow the closure portion of each product container to pass therethrough when the product container is angularly oriented at at least a minimum predetermined angle with respect to its free state orientation. The minimum predetermined angle can be varied by changing the size and/or shape of the stop member aperture, the actual establishment of the minimum predetermined angle depending upon such factors including, but not limited to, the desired locations and number of points of engagement between the peripheral edge of the stop member aperture and the lead bottle or product container, the contemplated angle of inclination of the overall device for a particular gravity feed operation, and the weight and number of the product containers to be suspended from the device in any particular product channel or track that will push and rest against the lead product container. The minimum predetermined angle, which will also be referred to as the minimum removal angle, should likewise be great enough that product containers will not inadvertently or unintentionally attain that angle during normal use, but such angle should not be so great as to make removal of the product containers inconvenient or burdensome to the consumer. Also, where a plurality of the present devices are to be located in spaced apart relationship one above the other, the removal angle should not be so great such that removal of a container suspended from a lower device will interfere with or contact containers suspended thereabove. Further, where it is anticipated that a device will be stocked from the front, ease of stocking should be another factor in selecting a removal angle.

It is also important to recognize that the present stop member can take on a wide variety of different shapes and sizes, the preferred construction being a generally planar member which is either integrally formed with or attachable to the front portion of the present devices so as to be oriented substantially perpendicular to the longitudinal axis of each respective product receiving track associated therewith. More specifically, the present stop member has an inner peripheral edge portion defining at least a portion of the aperture or opening extending therethrough, which peripheral edge portion includes opposite ends that terminate, respectively, at opposed, spaced apart locations adjacent to the forward end portions of each respective pair of rail members. This constructional configuration positions the terminal ends of the peripheral aperture edge of each stop member to engage spaced, opposed portions of the outer periphery of the closure portion of the lead product container positioned thereagainst so as to arrest and/or stop forward movement thereof when the product container is oriented in its suspended free state orientation. Importantly, however, this terminal end configuration is also configured such that it enables the neck of each respective container to pass therebetween such that the product container can be tilted, pivoted or angularly oriented through that portion of the aperture to its minimal angle for removal. That portion of the stop member aperture located above the terminal ends of the peripheral aperture edge is wider than the portion therebetween and is at least sufficiently large to allow passage of the closure portion of the product container therethrough when the product container is oriented at at least the minimal predetermined angle for removal. Although an aperture having various shapes could be utilized to provide this capability, it has been found that a generally round, ovoid, or other similarly shaped aperture is preferred as those shapes provide an additional narrower portion above the widest portion of the aperture which can likewise be positioned to engage the closure portion of the lead product container to provide additional stopping support therefor. Furthermore, with a round or similarly shaped aperture, the upper edge thereof can prevent the lead bottle or container from being merely lifted over the lower, narrower portion of the aperture, which construction is a safety feature that prevents the lead container from falling or otherwise becoming dislodged from the display unit when bumped or jarred during normal usage. A more rounded shape is also more aesthetically pleasing.

As noted above, the present devices can be readily and easily adapted for use with bottles or product containers having differently sized closure portions by utilizing optional adapter means for that purpose. The adapter means according to the present invention can include elongated strips or members provided in various widths to form the rail members or runners, which elongated adapter strips can be permanently or removably attached in at least partial overlaying relationship to existing rail members to narrow the space therebetween. The elongated strips or members can have a variety of different cross-sectional shapes including L-shaped, U-shaped, and substantially flat cross-sections, and such members can be attached to the rail members using suitable adhesives or other suitable means such as mechanical fasteners, frictional attachment, and the like.

Importantly, the present devices can also include optional means for changing the size of at least a portion of the stop member aperture for accommodating product containers having differently sized neck and closure portions. These optional means can include a plurality of removably replaceable stop members each having a differently sized and/or shaped aperture extending therethrough, or stop members capable of being positioned in overlaying relationship to a previously mounted stop member, these additional stop members having a peripheral edge portion defining at least a portion of an aperture therethrough which is smaller than the corresponding portion of the aperture associated with the previously mounted stop member. For example, according to one preferred embodiment, opposed flange or tab members are mounted on opposite sides of the stop member described above for receiving and holding a second stop member positioned in overlaying relationship thereto. In this regard, for a product channel or track having rail members spaced apart for use with bottles having 38 mm diameter closure portions and compatible stop means, such product track could be quickly and easily adapted for use with bottles having 28 mm diameter closure portions by attaching the optional elongated adapter members to the appropriate pair of rail members to narrow the space therebetween and affixing, in overlaying relationship to the first stop member, a second stop member having an aperture associated therewith adapted for accommodating containers having a 28 mm diameter closure portion. Conversely, a unit supplied with removable adapter strips mounted to the rail members and a removable, smaller stop member could be quickly adapted for use with larger bottles or containers by merely removing the adapter strips and the smaller stop member and replacing at least the smaller stop member with a larger one. Additionally, for even greater utility, the rear end portion of each pair of rail members can likewise be optionally provided with similarly constructed stop means such that either end of the present devices can be utilized as the forward or front end portion for dispensing purposes.

Several methods for manufacturing product merchandising display devices in accordance with the teachings of the present invention are likewise disclosed herein. Each method is predicated upon the use of a vacuum forming process, although other manufacturing processes and/or fabrication techniques can also be used, and each involves forming a layered composite structure as will be hereinafter further explained. The disclosed layered composite structure can also be provided with additional ribbed or corrugated members to improve the overall strength and stiffness of the completed unit.

OBJECTS OF THE INVENTION

It is therefore a principal object of the present invention to provide a suspension type gravity feed product merchandising display device with improved means for arresting and/or stopping the forward movement of product containers suspended therefrom while, at the same time, presenting the forwardmost or lead product containers for easy removal therefrom.

Another object is to provide a suspension type gravity feed display device which can be easily and quickly installed within existing display equipment, including refrigerated display coolers and cold vaults.

Another object is to provide a suspension type gravity feed display device having stop means which securely hold and prevent the forwardmost or lead product container in each row from inadvertently becoming dislodged from the unit and falling therefrom, yet which prominently and attractively displays the lead product container in each row and provides for easy access and removal.

Another object is to provide stop means for a suspension type gravity feed display device which will allow the device to be stocked from either end.

Another object is to provide a suspension type gravity feed product merchandising display device which is readily and easily adaptable for use with product containers having differently sized neck and/or closure portions.

Another object is to provide a suspension type gravity feed product merchandising display device which can be used with existing product merchandising display equipment and other support structures commonly utilized in supermarkets, convenience stores and other retail locations.

Another object is to teach the construction and operation of several embodiments of a suspension type gravity feed display device which can be easily manufactured using a vacuum forming process.

Another object is to teach several improved methods for the manufacture of a suspension type gravity feed product merchandising display device.

These and other objects and advantages of the present invention will become apparent to those skilled in the art after considering the following detailed specification which discloses several embodiments of the present suspension type gravity feed product merchandising display device and several methods for manufacturing the same in conjunction with the accompany drawings wherein:

DETAILED DESCRIPTION OF THE PREFERRED EMBODIMENTS

Figure 1:
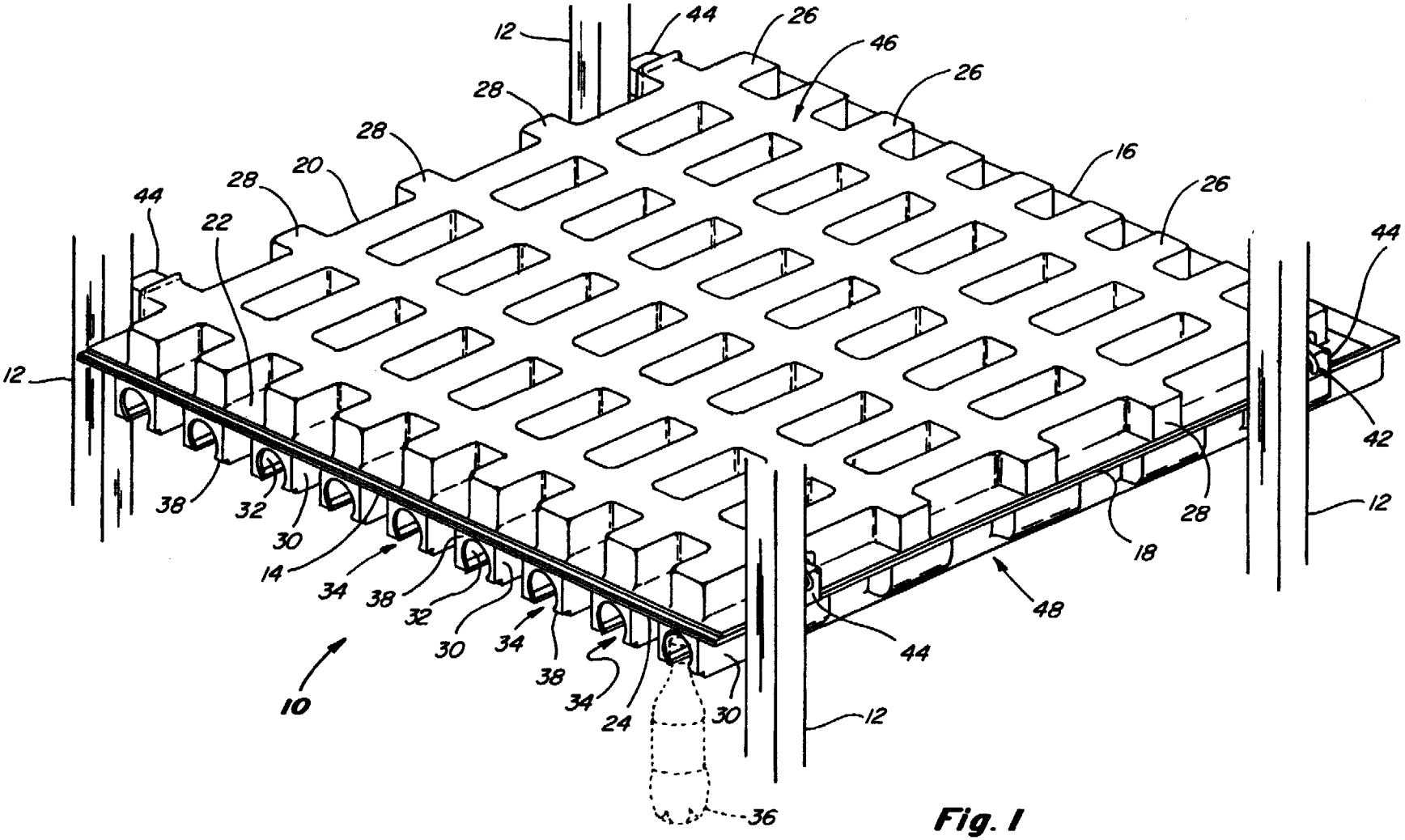
FIG. 1 is a perspective view of one embodiment of a suspension type gravity feed product merchandising display device constructed according to the teachings of the present invention, the present device being shown in a supported and inclined orientation for gravity feed operation between a plurality of spaced, upstanding support members commonly associated with existing product merchandising equipment.

Referring to the drawings more particularly by reference numbers wherein like numerals refer to like parts, number 10 in FIG. 1 identifies one embodiment of a suspension type product merchandising display device constructed according to the teachings of the present invention, the device 10 being shown supported in an inclined orientation for gravity feed operation by and between a plurality of spaced, upstanding support members 12. The support members 12 are of conventional construction and are typical of the type of vertical support means utilized in many of the known load carrying rack assemblies including refrigerated display coolers, visicoolers and other types of cold vaults used for displaying and merchandising items such as individual or multiple soft drink or fruit juice containers in locations such as conveniences stores, mini-marts, supermarkets, grocery stores and the like. Each upstanding support member 12 is typically of a rectangular, tubular construction and may include a plurality of spaced hooks, openings or other similar attachment means formed through one or more side surfaces thereof at spaced intervals along the length of the member such as the vertical spaced slots or openings 90 illustrated in FIG. 11. The present device 10 can be attached in supportive relationship to the upstanding support members 12 using a wide variety of conventional means such as hooks, clamps, cords, chains and the like, or any combination thereof. In the particular arrangement illustrated in FIGS. 1 and 11–13, the present device 10 is shown suspended from upstanding support members 12 using hook members 42, each hook member 42 having one end thereof insertable into a corresponding slot 90 associated with the upstanding support members 12 and having its opposite end insertable into an opening 83 associated with one end portion of a pair of horizontal support bar members 44 which extend laterally through device 10 as best shown in FIGS. 1, 8A, 9A and 10–13.

Figure 3:
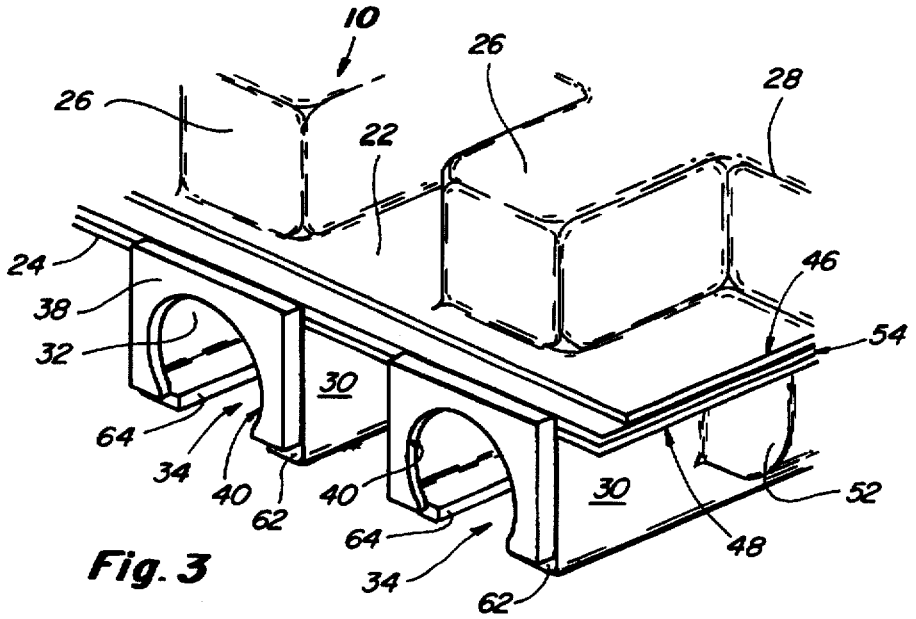
FIG. 3 is fragmentary perspective view showing two of the tracks associated with the display device of FIG. 1.
Figure 2A:
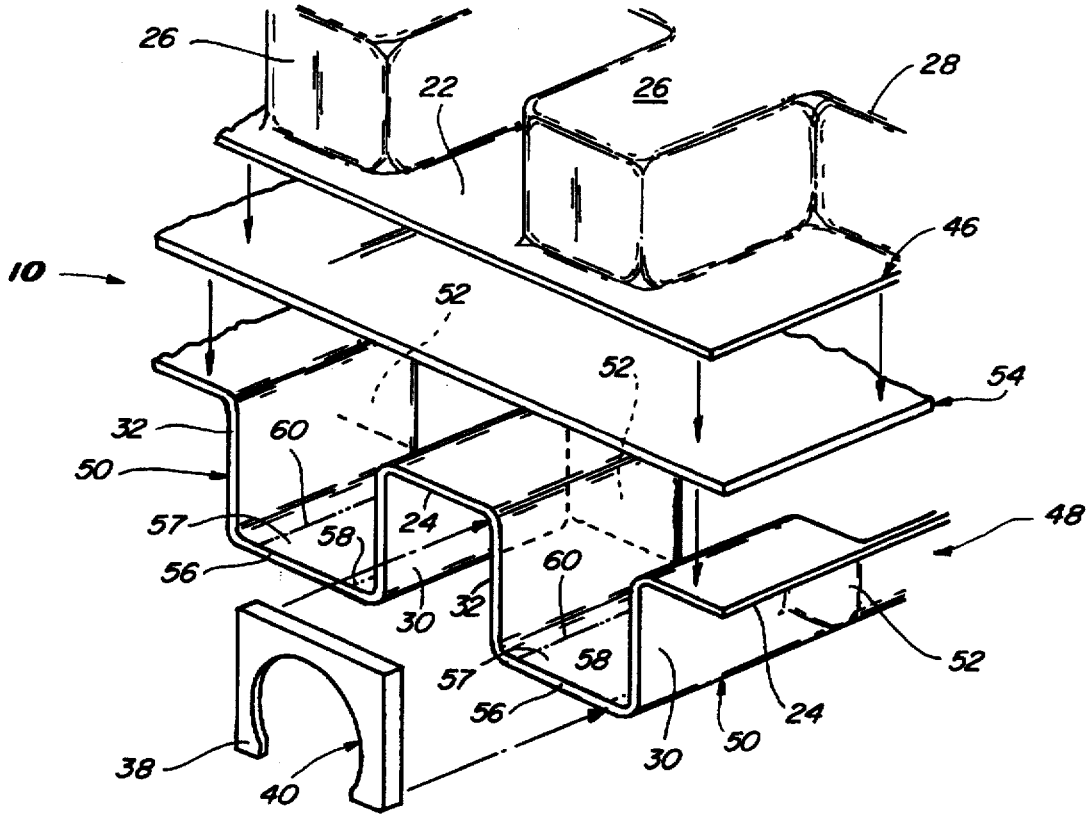
FIG. 2A is a fragmentary exploded perspective view of the display device of FIG. 1 illustrating the layered composite structure associated with this particular embodiment.

The present device 10, in its assembled condition, includes a forward or front end portion 14, a rear end portion 16, and opposed side portions 18 and 20 extending therebetween. Component wise, the device 10 includes a top member 46, an intermediate member 54, and a bottom member 48 as best shown in FIGS. 2A and 3, the top member 46 including a top surface 22 having a grid of longitudinally and laterally extending stiffening rib members 26 and 28 extending upwardly therefrom, while the bottom member 48 includes a surface 24 having a plurality of pairs of longitudinally extending spaced, opposed side wall portions 30 and 32 extending downwardly therefrom forming a plurality of adjacent tracks 34. As will be hereinafter further explained, each track 34 includes a pair of elongated rail members 62 and 64 adapted to receive and support for slidable movement therealong in a single row the closure portions of a plurality of bottles or other product containers such as the bottles 36 illustrated in FIGS. 1 and 13. Since the present device 10 is supported in an inclined orientation extending downwardly towards the forward end portion 14, the product containers suspended therein will slide forwardly in each respective track 34 towards the front portion 14 of the device 10 as the lead product container in each track 34 is removed therefrom. Importantly, in order to stop and/or arrest the forward movement of the containers in each respective track 34, a stop member 38 is positioned adjacent the forward end of each track 34 and is specifically designed so as to engage the closure portion of the forwardmost or lead container in each product track. When engaged with a stop member 38, each lead container will be prominently and attractively displayed in the device 10, the closure portion of each product container being displayed through an aperture 40 extending through the stop member 38.

Referring more particularly to FIGS. 2A and 3, the device 10 is a three layered composite structure formed by an upper planar member 46 having longitudinal and lateral stiffening rib members 26 and 28; a lower planar member 48 having a plurality of spaced, parallel, longitudinally extending U-shaped rib members 50 and a plurality of spaced, parallel lateral rib members 52; and a planar intermediate member 54 positioned therebetween. All of the members 46, 48, and 54 are preferably made from a plastic material, the members 46 and 48 as well as their corresponding rib members 26, 28, 50 and 52 all being formed using a vacuum forming process. The three members 46, 48 and 54 are thereafter joined together to form the device 10 illustrated in FIG. 3 using any suitable means of joinder, such as adhesives or ultrasonic welding.

Each U-shaped rib member 50 (FIG. 2A) of bottom member 48 becomes a track 34 (FIG. 3) and each includes a pair of opposed side wall portions 30 and 32 having their respective bottom edge portions attached to or integrally form with a bottom wall portion 56 extending therebetween. The upper edge portions of side walls 30 and 32 are similarly joined to or integrally formed with the surface 24 of member 48. The tracks 34 are formed from the U-shaped rib members 50 by removing an intermediate portion of bottom wall 56, which intermediate portion is spaced from both side wall portions 30 and 32 such as the intermediate portion 57 located between dotted lines 58 and 60. Once the intermediate portion 57 is removed, the remaining portions of bottom wall 56 form spaced, opposed rail members 62 and 64 as shown in FIG. 3. Removal of intermediate bottom wall portions 57 can be accomplished by any suitable means such as by cutting such portions along lines 58 and 60 with appropriate cutting means. The stop members 38, which are also formed of plastic material, are fixedly attached respectively adjacent the forward end portion of the respective pairs of spaced, opposed side wall portions 30 and 32 using any suitable means such as adhesives or ultrasonic welding such that the apertures 40 are located in communication with the spaces defined by and between the side wall portions 30 and 32 and the respective pair of rail members 62 and 64 associated therewith. It should also be noted that stop members 38 can alternatively be removably mounted to the present device 10 using suitable means so as to be replaceable with other stop members such as stop members adapted for use with different types or styles of product containers, or stop members adapted for use with product containers having differently sized neck and closure portions.

Figure 2B:
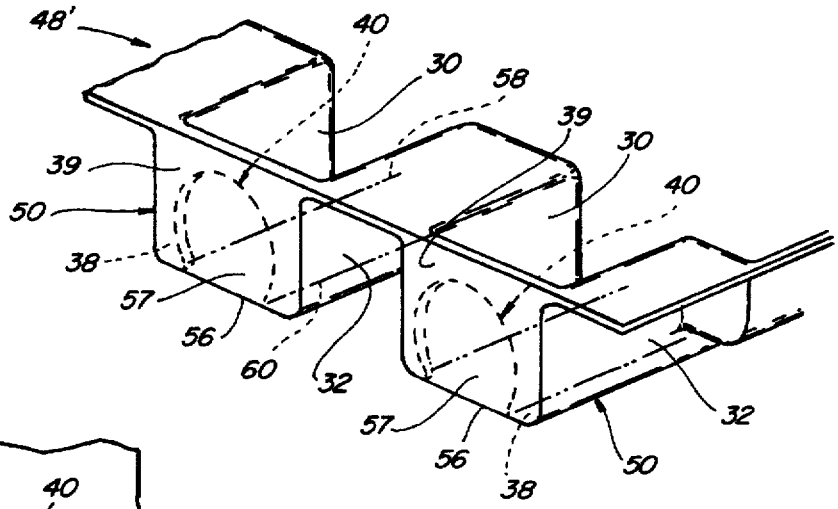
FIG. 2B is a fragmentary perspective view of another embodiment of the lower member forming the composite structure illustrated in FIGS. 1 and 2A.

FIG. 2B illustrates another embodiment 48' of the lower member 48 illustrated in FIG. 2A wherein the front wall member 39 forming each respective stop member 38 is integrally formed with each respective U-shaped rib member 50. In this particular embodiment, the tracks 34 are formed from the member 48' by first cutting or drilling the aperture 40 through each front wall member 39 and thereafter cutting or otherwise removing the intermediate portion 57 of bottom wall 56 located between the dotted lines 58 and 60. This particular method of fabrication enables the respective stop members 38 to be integrally formed into the front wall portion of the lower member 48' thereby eliminating the need to fixedly attach the same to the forward end portion of each respective U-shaped rib member 50. This produces an overall stronger construction as well as a more aesthetically pleasing front wall appearance. In all other respects, the construction of the lower member 48' is substantially identical to the construction of the lower member 48 illustrated in FIG. 2A.

Figure 4:
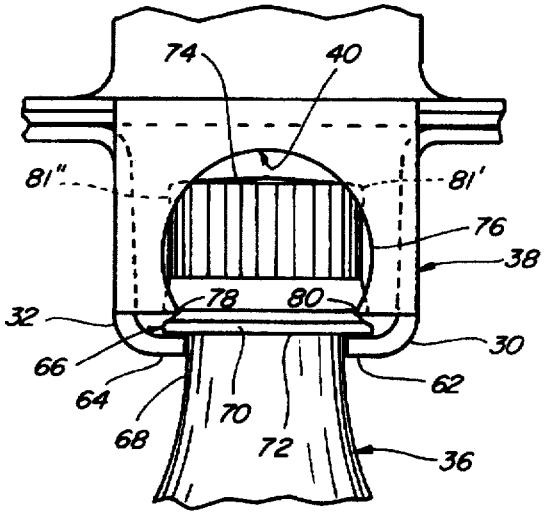
FIG. 4 is a fragmentary front elevational view of the display device of FIG. 1 showing a bottle suspended from one of the tracks thereof.

FIG. 4 shows a typical bottle 36 suspended by its closure portion 66 from rail members 62 and 64 associated with a typical track 34 of device 10. Bottle 36 is of a conventional construction and is representative of a wide variety of soft drink and fruit juice bottles or containers currently in use. Closure portion 66 of bottle 36 is located above the bottle neck portion 68 and includes a lowermost annular flange portion 70 having an underside surface 72 located adjacent to and extending outwardly from neck portion 68. Closure portion 66 further includes a removable cap or closure member 74 which is threadedly secured or otherwise mounted to the top of the container 36 above the annular flange portion 70. Flange portion 70, as well as neck portion 68, have known, predetermined width dimensions, and the rail members 62 and 64 are spaced sufficiently far apart to allow for the relatively free passage of neck portion 68 therebetween. On the other hand, the rail members 62 and 64 are spaced sufficiently close together such that at least a portion of the underside surface 72 of flange portion 70 will engage and rest upon the rail members 62 and 64 for supporting the bottle 36 for slidable movement therealong. As previously noted, stop member 38 is positioned adjacent the front portion of each pair of rail members 62 and 64 to stop and/or arrest the forward movement of the forwardmost or lead bottle 36 suspended thereon so as to prevent the lead bottle from becoming disengaged with the track 34, while, at the same time, prominently displaying the closure portion of the particular bottle through the forwardly facing aperture 40. In this regard, stop member 38 includes a peripheral edge portion 76 defining at least a portion of the aperture 40, which peripheral edge 76 includes spaced, opposed terminal ends 78 and 80 positioned to engage spaced portions of the outer periphery of the flange 70 and/or cap 74 for stopping and/or arresting forward movement of the bottle. Whether the terminal ends 78 and 80 engage flange portion 70 or cap 74 depends on several factors including the angle of inclination of the device 10, the position of terminal ends 78 and 80 with respect to rail members 62 and 64, and the lateral spacing between the terminal ends 78 and 80 and the overall dimensions of the bottle flange and cap. Also, depending on the above factors, the flange portion 70 and/or cap 74 may engage the peripheral edge portion 76 of stop member 38 forming the aperture 40 at one or more other more upwardly located positions such as at the locations 81' and 81" illustrated in FIG. 4 as will be hereinafter further explained below.

Figure 5:
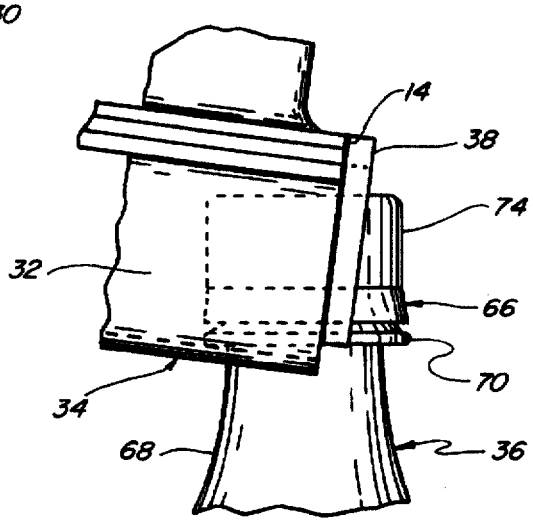
FIG. 5 is a fragmentary side elevational view of the track and bottle illustrated in FIG. 4.
Figure 13:
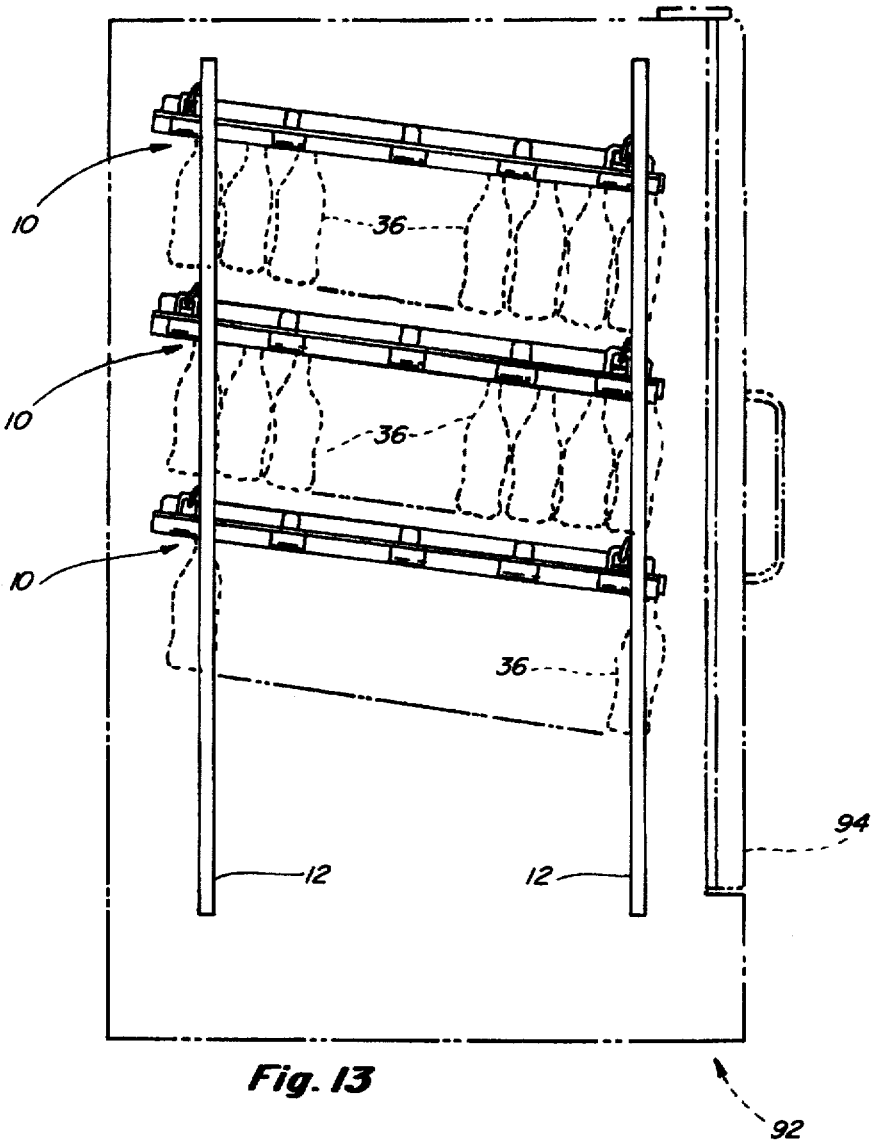
FIG. 13 is a side elevational view showing a plurality of the present display devices installed in a typical prior art refrigerated display cooler assembly in an inclined gravity feed orientation, a plurality of soft drink bottle containers also being shown in dotted outline form suspended in operative position from the present devices.

Referring to FIG. 5, when engaged with stop member 38, closure portion 66 of lead bottle 36 is captured or framed in aperture 40 such that most of the closure portion 66 is visible through the aperture 40 and some of the bottle closure portion extends forwardly therethrough. This is an important feature of the present invention from a merchandising perspective as it allows the lead bottle to be more fully and prominently displayed and facilitates easy and convenient removal of the bottle or product container from track 34. Referring again to FIG. 4, that portion of aperture 40 located above the terminal end portions 78 and 80 is also sized and shaped so as to allow the easy and convenient removal of the closure portions of the bottles 36 from track 34 by merely pivoting or tilting each bottle 36 such that it is oriented at at least a minimal predetermined angle with respect to its free state orientation, which free state orientation is typically a generally upright orientation as shown in FIGS. 1, 4, 5 and 13. In this regard, it should be recognized that aperture 40 can have a wide variety of different shapes, the generally round shape illustrated in FIG. 4 being preferred for simplicity and ease of manufacture. Also, the peripheral edge 76 defining the upper portions of a round or similarly shaped aperture 40 is positioned so as to be engageable with other portions of the closure portion of a particular product container such as the upper portions of cap member 74 illustrated in FIG. 4 engaging the upper peripheral edge portions 81' and 81" of aperture 40. This additional engagement provides additional support for the lead bottle or product container at additional, more upward locations on the closure portion 66 thereby substantially minimizing the possibility that the lead product container could be inadvertently jarred upwardly and over terminal edge portions 78 and 80 so as to fall from the display device 10.

Figure 6:
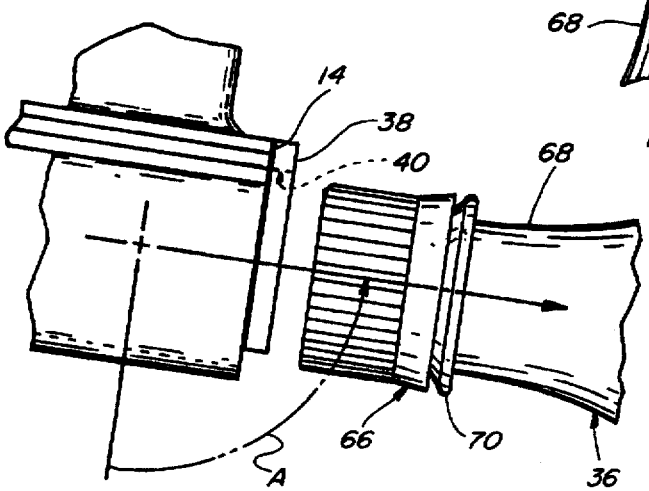
FIG. 6 is another fragmentary side elevational view of the track and bottle illustrated in FIG. 4 showing removal of the lead bottle therefrom.

FIG. 6 illustrates the ease with which the closure portion 66 of bottle 36 can pass through the aperture 40 when bottle 36 is oriented at at least the minimal predetermined angle with respect to its free state orientation illustrated in FIGS. 4 and 5, which removal angle is designated by the letter A in FIG. 6. In other words, a bottle 36 can be easily removed from track 34 by simply grasping bottle 36 and pivoting or angularly rotating the same about its closure portion such that neck portion 68 passes between the terminal edge portions 78 and 80 of stop member 38 and thereafter easily and conveniently pulling the closure portion 66 of the bottle 36 forwardly through the aperture 40 as illustrated. As bottle 36 is removed, any second and subsequent bottles suspended from track 34 will then automatically advance downwardly towards the front portion 14 of the present device 10, the second bottle then becoming the lead bottle in that particular product row.

Depending upon the particular size and configuration of the neck and closure portions of the product containers to be suspended from the present device 10 within the tracks 34 as well as other factors and considerations discussed below, it has been found that a minimum predetermined angle A (FIG. 6) of between about 50° to about 100° provides a desirable condition and suitable angular orientation of the product container relative to its free state orientation so as to allow the closure portion of such product container to easily pass through the aperture 40. The specific minimum predetermined angle A for any particular application will also depend upon the particular inclination or gravity feed slope of the present devices 10 when mounted within existing display equipment; the spacing between the terminal edge portions 78 and 80; the shape and configuration of the aperture 40; and the spacing between the rail members 62 and 64. The angular rotation range of about 75° to about 95° was found to work well with most product container configurations presently utilized in the soft drink and fruit juice industry. Other predetermined angular orientations in the range from about 50° to about 100° have likewise been tested and provide suitable results for some applications depending upon the particular product container configuration being suspended within the present tracks 34.

Figure 7:
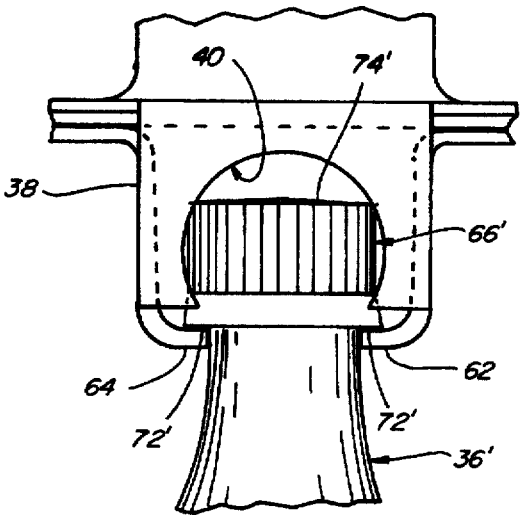
FIG. 7 is a fragmentary front elevational view similar to FIG. 4 showing a bottle having a different closure configuration associated therewith suspended from one of the present tracks.

It is also recognized and anticipated that the present tracks 34 and stop members 38 will accommodate a wide variety of different product containers having a wide variety of different cap or closure portion configurations, including product containers not utilizing an annular flange or other projection that extends outwardly around the neck portion of a particular container such as the annular flange portion 70 discussed above and illustrated in FIGS. 4 and 5. In this regard, the present invention will work equally well with product containers that utilize a simple cap or lid member of the screw-on type, or of the older press-on or compression type. This particular arrangement is best illustrated in FIG. 7 wherein the product container 36' utilizes a closure portion 66' which is comprised simply of a conventional screw-on type cap member 74'. In this particular bottle closure configuration, it is the lower edge surface 72' of cap member 74' which engages and rests upon the rail members 62 and 64 as illustrated in FIG. 7. In all other respects, the product container 36' functions, moves and operates within the present tracks 34 as previously described above with reference to bottle or product container 36. Other closure configurations will likewise work equally as well with the present device 10.

Figure 11:
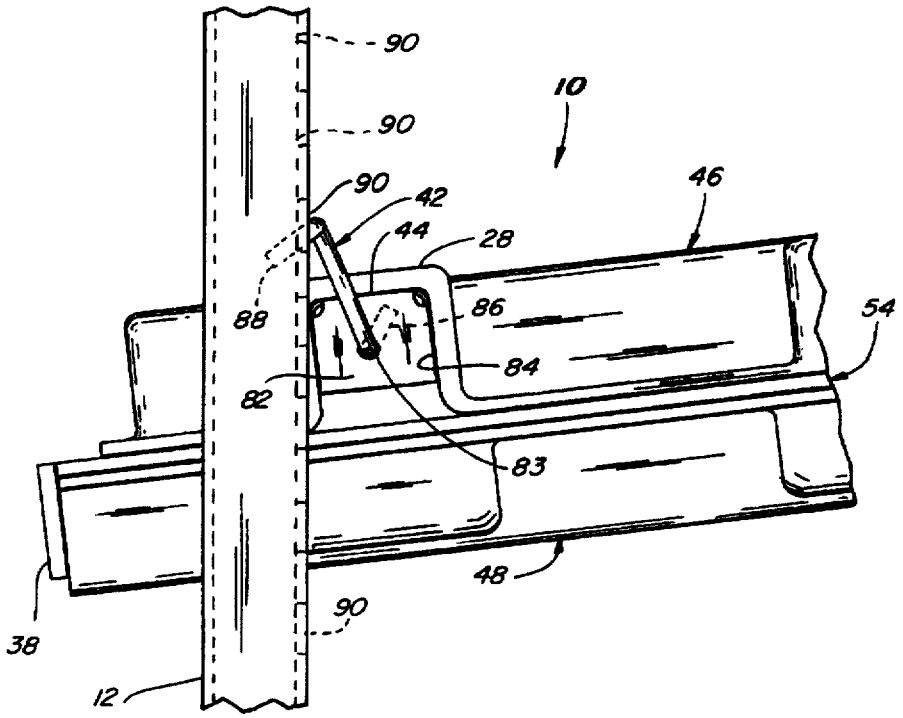
FIG. 11 is a fragmentary side elevational view of the display device of FIG. 1 showing attachment of one of the horizontal support bar members to one of the upright support members commonly associated with existing display equipment.
Figure 12:
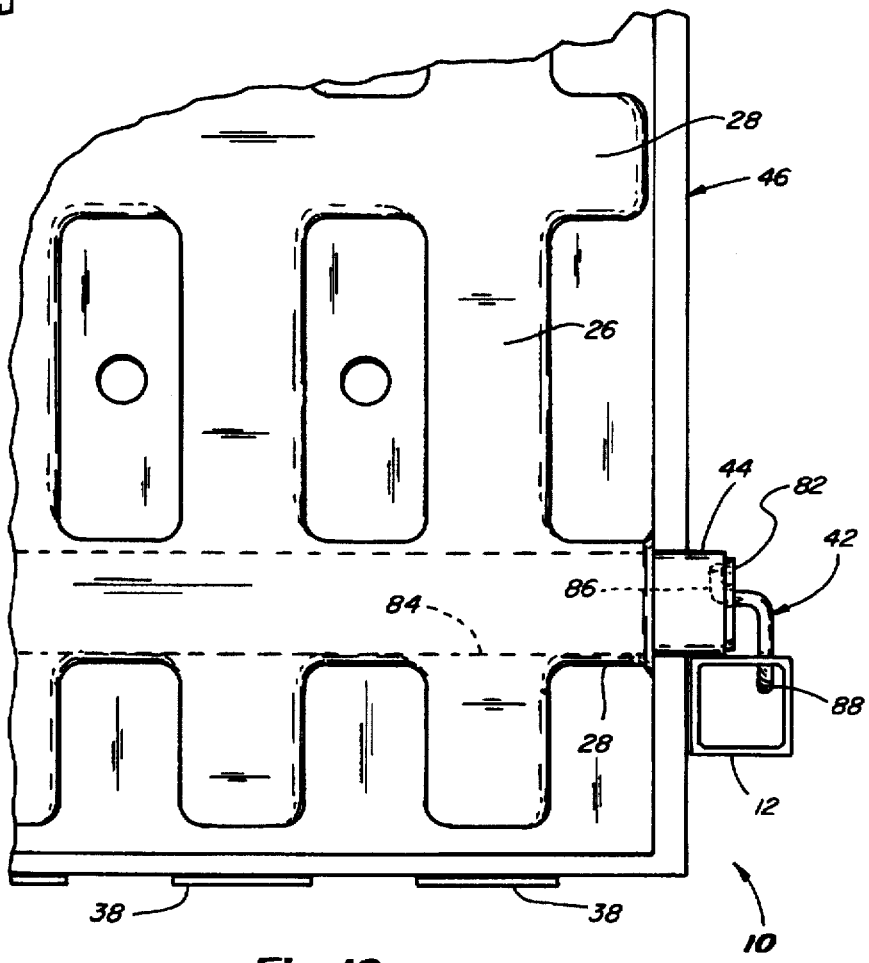
FIG. 12 is a fragmentary top planform view of the portion of the present device illustrated in FIG. 11.

A pair of horizontal support bar members 44 such as the member 44 illustrated in FIGS. 8A, 9A, 11 and 12 are utilized to quickly and easily suspend the present device 10 within existing display equipment such as a wide variety of different types of refrigerated display coolers and cold vaults. Each support bar 44 is an elongated member of stamped or tubular construction having opposite end faces 81 and 82, each end face having an opening 83 extending therethrough. Each support bar member 44 is sized and shaped for insertion through one or more internal lateral passageways 84 extending through at least some of the lateral stiffening rib members 28 associated with the top member 46 as best shown in FIGS. 1, 11 and 12. Each horizontal support bar member 44 is of sufficient length so that when installed within one of the passageways 84 of member 46, the opposite ends of the bar will protrude somewhat from each end of passageway 84 as best shown in FIGS. 1 and 12.

As best illustrated in FIGS. 1 and 12, the reinforcing or stiffening rib members 28 housing the passageways 84 are positioned and located at spaced locations from the respective front and rear portions of the device 10 such that when the support bar members 44 are insertably positioned therewithin, each opposite end face 81 and 82 of each member 44 will be positioned and located in close proximity to one of the upright support members 12 as shown in FIGS. 1, 11 and 12. As best illustrated in FIG. 11, each upright support member 12 includes a plurality of slots or openings 90 positioned at spaced locations along the length thereof, the openings 90 being ideally suited for receiving one end portion of a hook member such as hook member 42 illustrated in FIG. 10. More particularly, hook member 42 includes opposite end portions 86 and 88 which are oriented angularly with respect to one another so as to be insertable respectively into openings 83 and 90. For example, one end portion 86 of hook member 42 is insertably receivable within the opening 83 associated with each opposite end face of the support bar members 44 and the opposite end portion 88 of hook member 42 is insertably receivable into any one of the slots or openings 90 associated with the respective upright support members 12 for suspending the present device 10 therefrom. The position and location of the present device relative to the upright support members 12 as well as the angular orientation or inclination of such device from front to rear can be easily adjusted and varied depending upon which particular slots or openings 90 are selected with respect to the front and rear support members 12. Depending upon which pair of support member openings 90 are selected, various inclined orientations for gravity feed operations can be achieved. Although FIGS. 1, 11 and 12 disclose the use of a single hook member 42 for attaching each respective opposite end face of the support bar members 44 to a corresponding upright support member 12, it is recognized and anticipated that a wide variety of other mounting means for accomplishing this task may likewise be utilized. For example, suspension cords, chains, a plurality of hook members coupled together, or any combination thereof, may be utilized to suspend the present device 10 from the upright support members 12.

Figure 9A:
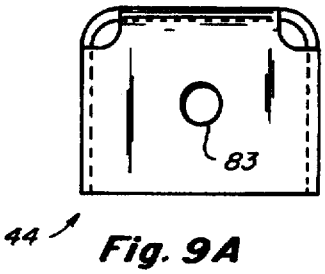
FIG. 9A is an end elevational view of the horizontal support bar member of FIG. 8A.
Figure 9B:
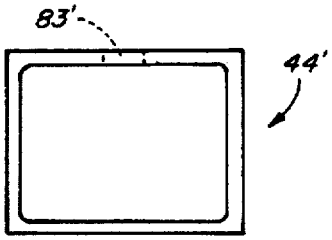
FIG. 9B is an end elevational view of the horizontal support bar member of FIG. 8B.
Figure 10:
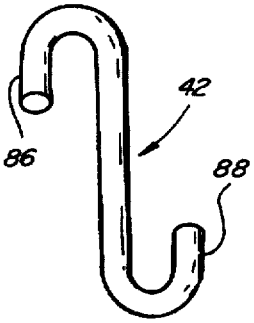
FIG. 10 is a perspective view illustrating a typical hook member which may be utilized to install the present devices within existing display equipment.
Figure 8A:
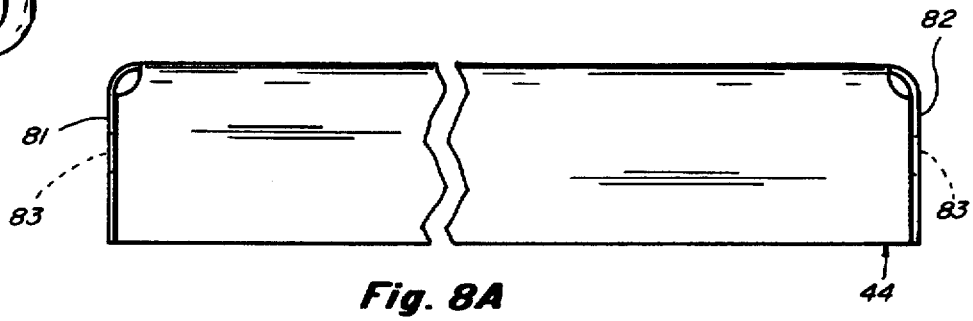
FIG. 8A is front elevational view of one embodiment of the horizontal support bar members from which the present device is suspended and attached to existing display equipment.
Figure 8B:
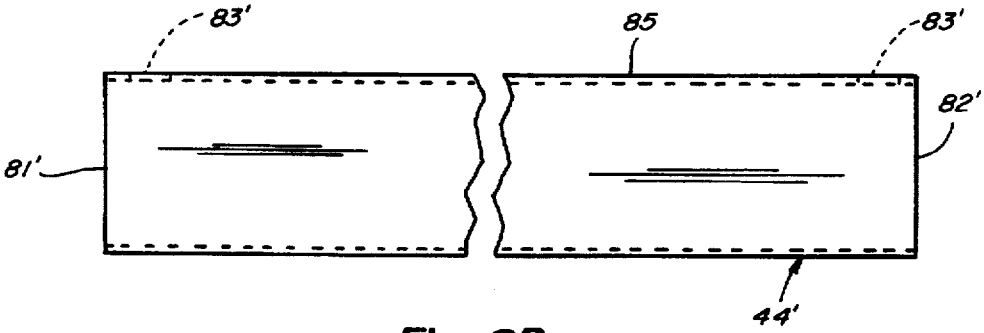
FIG. 8B is a front elevational view of another embodiment of the horizontal support bar member of FIG. 8A.

FIGS. 8B and 9B illustrate another embodiment 44' of the support bar members which may be utilized to quickly and easily suspend the present device 10 within existing display equipment. Support bar members 44' differ from support members 44 in that their respective end portions 81' and 82' are completely open as best illustrated in FIG. 9B and the openings 83' have been relocated to the upper tubular wall surface 85 adjacent each opposite end thereof as best shown in FIG. 8B. The respective openings 83' are positioned and located from the respective opposite end portions of the upper wall surface 85 such that when the opposite ends of the bar member 44' protrude beyond each end of passageway 84, the respective openings 83' are exposed and one end portion of hook member 42 may be insertably positioned within the opened end portions of the member 44' and through the opening 83' for engagement therewith. In all other respects, the support bar members 44' function and operate in the same manner as support bar members 44.

FIG. 13 illustrates use of a plurality of the present devices 10 installed for gravity feed operations in a typical prior art display cooler 92 having upright support members 12 associated therewith. The cooler 92 is representative of a wide variety of product display coolers presently in use and includes a front glass door 94 which provides product visibility and access for consumers. Products typically merchandised and displayed in such coolers such as soft drink bottle containers 36 are shown in dotted outline form suspended from the present product tracks 34. The front end portion 14 of each device 10 is located adjacent the cooler door 94 such that consumers can open door 94, grasp a lead bottle 36, and by merely pulling the lead bottle forward while, at the same time, tilting or rotating the bottle through at least the minimal predetermined angle, the bottle 36 can be easily and conveniently removed from the device 10. As explained above, as the bottle 36 is removed, the second bottle suspended therebehind from the same track will then advance to the lead position for removal therefrom. Regardless of the gravity feed inclination of the present devices 10, each track 34 can be easily stocked from either the front or the rear of cooler 92, and each device 10 can be positioned at a desired height above an adjacent unit simply by selecting the appropriate slots 90 in the corresponding upright support members 12 to achieve the desired spacing. In this regard, the vertical spacing between adjacent devices 10 can be adjusted and varied so as to accommodate bottled containers of varying height and/or configuration.

Figure 14:
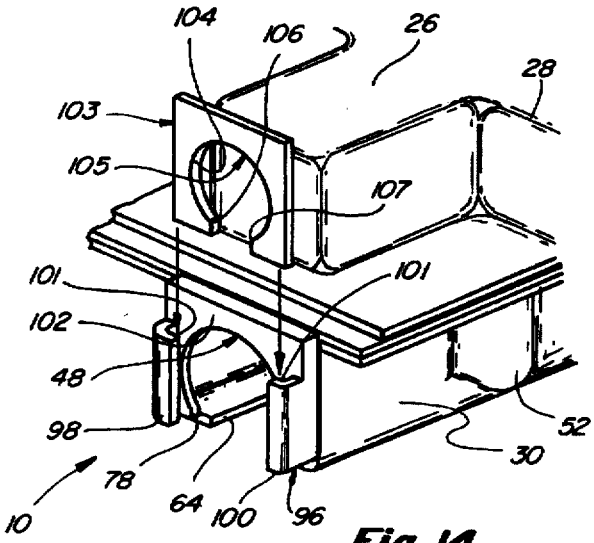
FIG. 14 is a fragmentary perspective view of the display device of FIG. 1 showing an optional alternative stop member construction in association therewith.

FIG. 14 illustrates one track 34 of the present device 10 equipped with an optional alternative stop member construction 96. Stop member 96 is constructed substantially the same as stop member 38 described above, but additionally includes tabs or flange portions 98 and 100 extending forwardly from the stop member on opposite sides of aperture 40 as illustrated. Tabs 98 and 100 are somewhat L-shaped in construction and form a slot or space 101 between the front surface 102 of the stop member 96 and a portion of each respective tab 98 and 100, the opposed slots 101 being adapted for receiving and holding therewithin an optional second stop member 103. The second stop member 103 represents a means for changing the size of at least a portion of the aperture 40 associated with stop member 96 for accommodating product containers having differently sized neck and closure portions. In this regard, stop member 103 can be constructed such that the peripheral edge portion 104 defining at least a portion of the aperture 105 extending therethrough is smaller than the corresponding portion of the aperture 40 associated with stop member 96. This means that when the stop member 103 is positioned within the slots 101 in overlaying relationship to the front surface 102 of the stop member 96, product containers having closure portions which will freely pass through aperture 40 without any arrestment by stop member 96 will, in fact, engage at least a portion of the peripheral edge portion of aperture 105 associated with stop member 103 and this will stop the forward movement of a smaller product container suspended within that particular product track. It is also contemplated that the present device 10 can be accompanied by a plurality of removably positionable stop members such as the stop member 103, each of said plurality of removably positionable stop members having apertures associated therewith which are sized and shaped so as to accommodate product containers having a plurality of differently sized neck and closure portions.

Figure 15A:
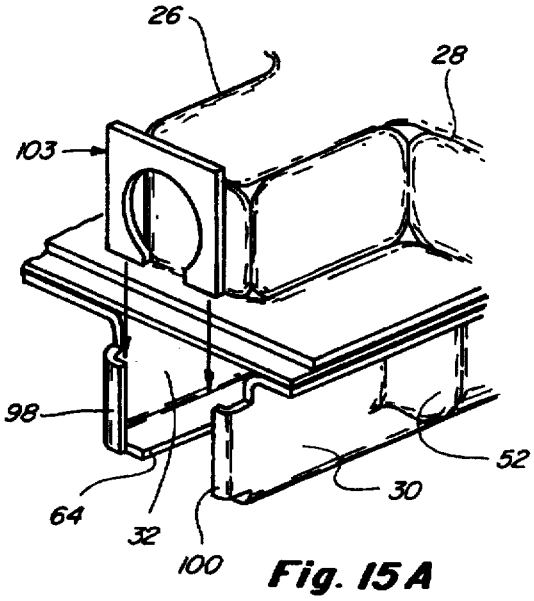
FIG. 15A is a fragmentary perspective view of another optional construction for accommodating a plurality of differently sized removably positionable stop members.

It is further recognized and anticipated that accommodation of smaller product containers can likewise be accomplished by keeping the size and configuration of the apertures 40 and 103 substantially identical, but instead, varying the spacing between the aperture terminal edge portions 78 and 80 of stop member 96. In this particular embodiment, the spacing between the terminal edge portions 106 and 107 associated with stop member 103 would be smaller than the spacing between the terminal edge portions 78 and 80 associated with stop member 96. This optional feature would enable a user to merchandise differently sized product containers in adjacent product rows or tracks 34 by merely selecting the appropriately sized stop member for that particular product row and inserting the same within the opposed slots or spaces 101 associated with stop member 96 if the particular stop member so selected is different from stop member 96. It is also anticipated that the tab or flange portions 98 and 100 can be integrally formed or fixedly attached directly to the side wall portions 30 and 32 forming each respective track 34 as illustrated in FIG. 15A such that all of the differently sized stop members such as stop members 38 (FIG. 2) and 103 (FIG. 14) can be selectively removably positioned adjacent the front end portion of each respective track 34. This particular construction would obviate the need for positioning one stop member in overlaying relationship to another stop member thereby simplifying the overall construction of the front portion of the present device 10.

Figure 15B:
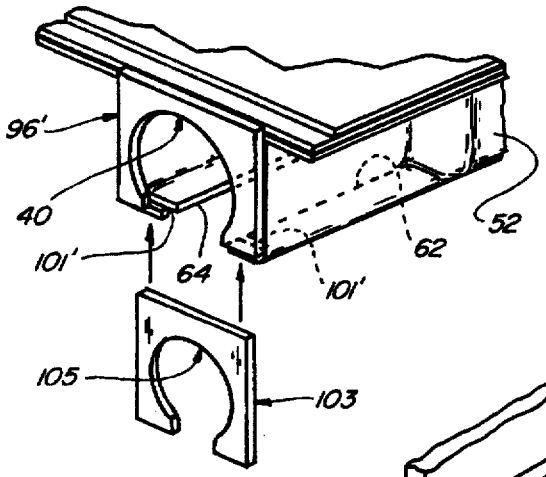
FIG. 15B a fragmentary perspective view of the display device of FIG. 1 showing still another optional stop member construction.

FIG. 15B illustrates still another optional stop member construction wherein a plurality of stop members can be selectively removably positioned adjacent the forward portion of each respective track 34. In the particular configuration illustrated in FIG. 15B, the tab or flange portions 98 and 100 associated with the construction illustrated in FIGS. 14 and 15A have been eliminated and the opposed slots or spaces 101' have been repositioned to the rear of stop member 96' as illustrated in FIG. 15B. The spaces 101' are formed between the opposed rail members 62 and 64 and the rear portion of the stop member 96' such that an additional stop member having a differently sized aperture associated therewith such as the stop member 103 can be slidably positioned within the slots 101', from the bottom up, in overlaying relationship to the rear surface of stop member 96'. The stop member 103 functions as previously explained to accommodate product containers having differently sized neck and closure portions as compared to the aperture 40 associated with stop member 96' and such member can be held in operative position adjacent the back surface of stop member 96' via a wide variety of suitable holding means. Such holding means may include the use of adhesives; a tight frictional engagement between the stop member 103 and the respective slots 101'; sizing the stop member 103 such that a portion of the opposed rail members 62 and 64 extend over at least a portion of the bottom edge of the member 103 when such member is operatively positioned adjacent the back surface of stop member 96'; and still other cooperatively engageable means. It is anticipated that a plurality of removably positionable stop members such as the stop member 103 can likewise be utilized in this particular arrangement as previously explained with reference to the constructions illustrated in FIGS. 14 and 15A so as to accommodate product containers having a plurality of differently sized neck and closure portions.

Figure 16:
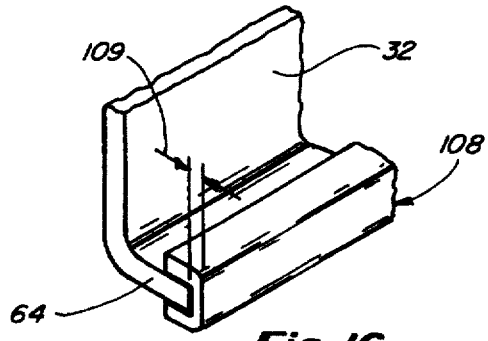
FIG. 16 is an enlarged fragmentary perspective view of a typical rail member associated with one of the present tracks showing one embodiment of optional means for adapting the rail members for use with product containers having differently sized neck and/or closure portions.
Figure 18:
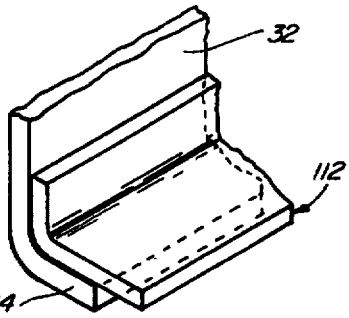
FIG. 18 is an enlarged fragmentary perspective view of a typical rail member similar to FIGS. 16 and 17 showing still another embodiment of optional means for adapting the present rail members for use with product containers having differently sized neck and/or closure portions.
Figure 17:
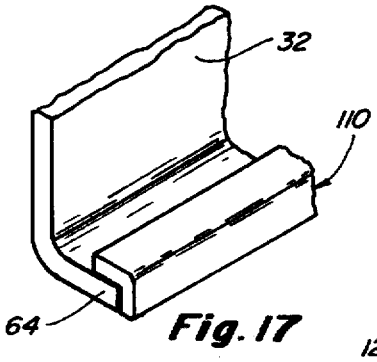
FIG. 17 is an enlarged fragmentary perspective view of a typical rail member similar to FIG. 16 showing another embodiment of optional means for adapting the present rail members for use with product containers having differently sized neck and/or closure portions.

Because product containers such as bottled soft drink and fruit juice containers are available in a wide variety of different sizes such as 16 oz., 20 oz., 1, 2 and 3 liter soft drink containers, it may be necessary to adjust the lateral spacing between opposed rail members 62 and 64 in any particular track 34 in order to engage the closure portion of the particular sized product container suspended therewithin. In this regard, FIGS. 16–18 illustrate several alternative embodiments of optional elongated adapter strips which may be attached in overlaying relationship to rail members 62 and/or 64 using any suitable means such as adhesive means in order to reduce the lateral spacing between the rail members 62 and 64 in that particular track 34 so as to adapt that product track for use with bottles or product containers having smaller neck and/or closure portions. More particularly, adapter strip embodiment 108 illustrated in FIG. 16 is of a U-shaped cross-sectional construction and is adapted for placement in overlaying relationship to the edge of any particular rail member such as the rail member 64 so illustrated. Adapter strip 108 will reduce the lateral spacing between any respective pair of opposed rail members 62 and 64 by an amount equal to the thickness of the portion 109 illustrated in FIG. 16. For obvious reasons, it is anticipated that an adapter strip 108 would be attached to each rail member 62 and 64 in any particular track 34 if the lateral space therebetween must be reduced.

In similar fashion, FIG. 17 illustrates another alternative adapter strip embodiment 110 having a L-shaped cross-sectional construction, which embodiment 110 is adapted for placement such that one leg thereof is located on top of a particular rail member and the other leg of strip member 110 extends over the edge of such rail member so as to narrow the space between the respective pair of rail members 62 and 64. FIG. 18 illustrates still another adapter strip embodiment 112 likewise of an L-shaped construction, the adapter embodiment 112 being positioned and located in contact with both the rail member 64 and the side wall 32 as illustrated, one leg of the L-shaped adapter strip 112 extending into the space between a respective pair of rail members 62 and 64 so as to narrow the same. Adapter embodiment 112 provides more surface area for attaching the member 112 to members 32 and 64, which arrangement may be necessary depending upon the overall weight of the particular product containers to be suspended therefrom.

In certain applications depending upon the angle of inclination imparted to the present devices 10 as well as the particular construction of the display equipment into which the present devices 10 are installed, it may be advantageous to attach the stop member 38 or 96 adjacent the front end portion of each respective track 34 such that its upper portion is located more forward as compared to its lower portion so as to further facilitate removal of product containers from each respective track. This forward tilt of the front stop member may be achieved by simply placing a spacer member adjacent the upper back surface of the particular stop member prior to affixing the same to the front portion of each respective track 34. This forward tilt of the front stop member functions to control the free state orientation of the lead product container and serves to control the mount of forward tilt, if any, imparted to such lead container.

It is also recognized and anticipated that an additional stop member may be positioned adjacent to the rear end portion of each pair of rail members 62 and 64 forming each respective track 34, this rear stop member being constructed substantially similar to the stop member utilized adjacent the front portion of the trait. If stop members are positioned adjacent the rear end portion of the present device 10, the present device 10 then becomes reversible and the front and rear portions of the device 10 are interchangeable. This means that the present device 10 can be mounted within existing equipment with either end portion extending towards the front of the unit such as the display cooler 92 illustrated in FIG. 13. This not only facilitates installation, but is also further facilitates product loading and removal since products can be both loaded and removed from either end of the respective tracks 34.

Figure 20:
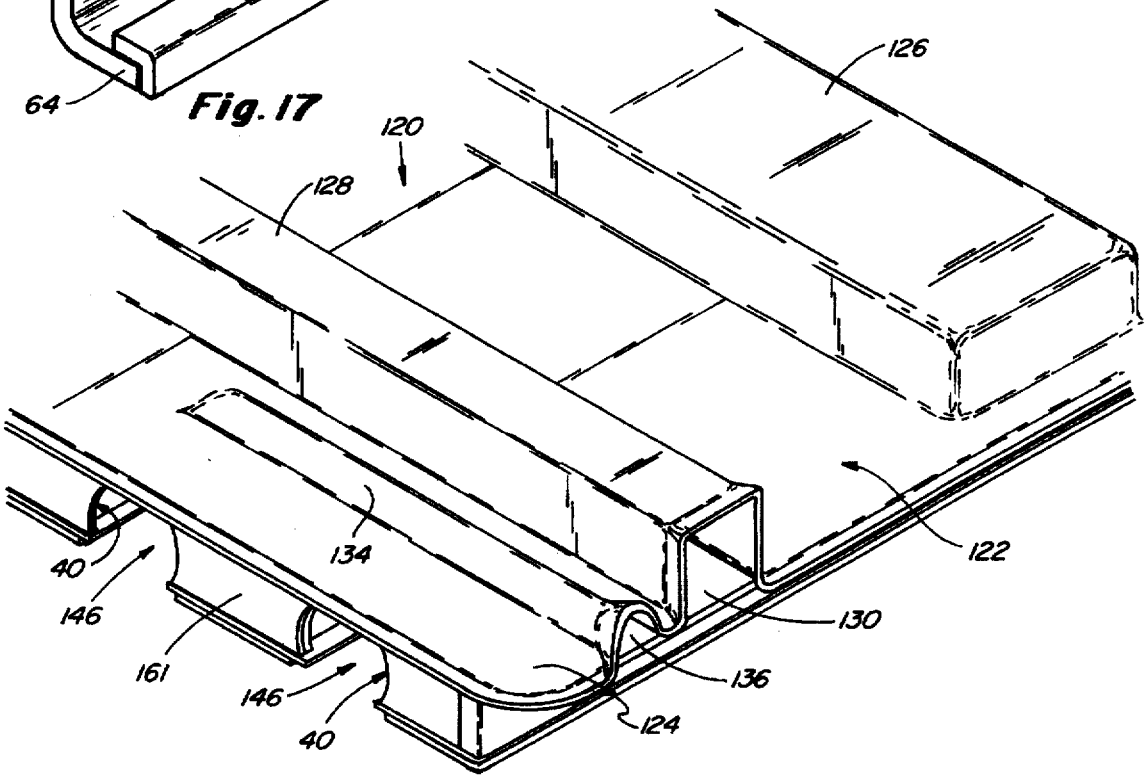
FIG. 20 is a fragmentary perspective view showing the display device of FIG. 19 in assembled form.
Figure 19:
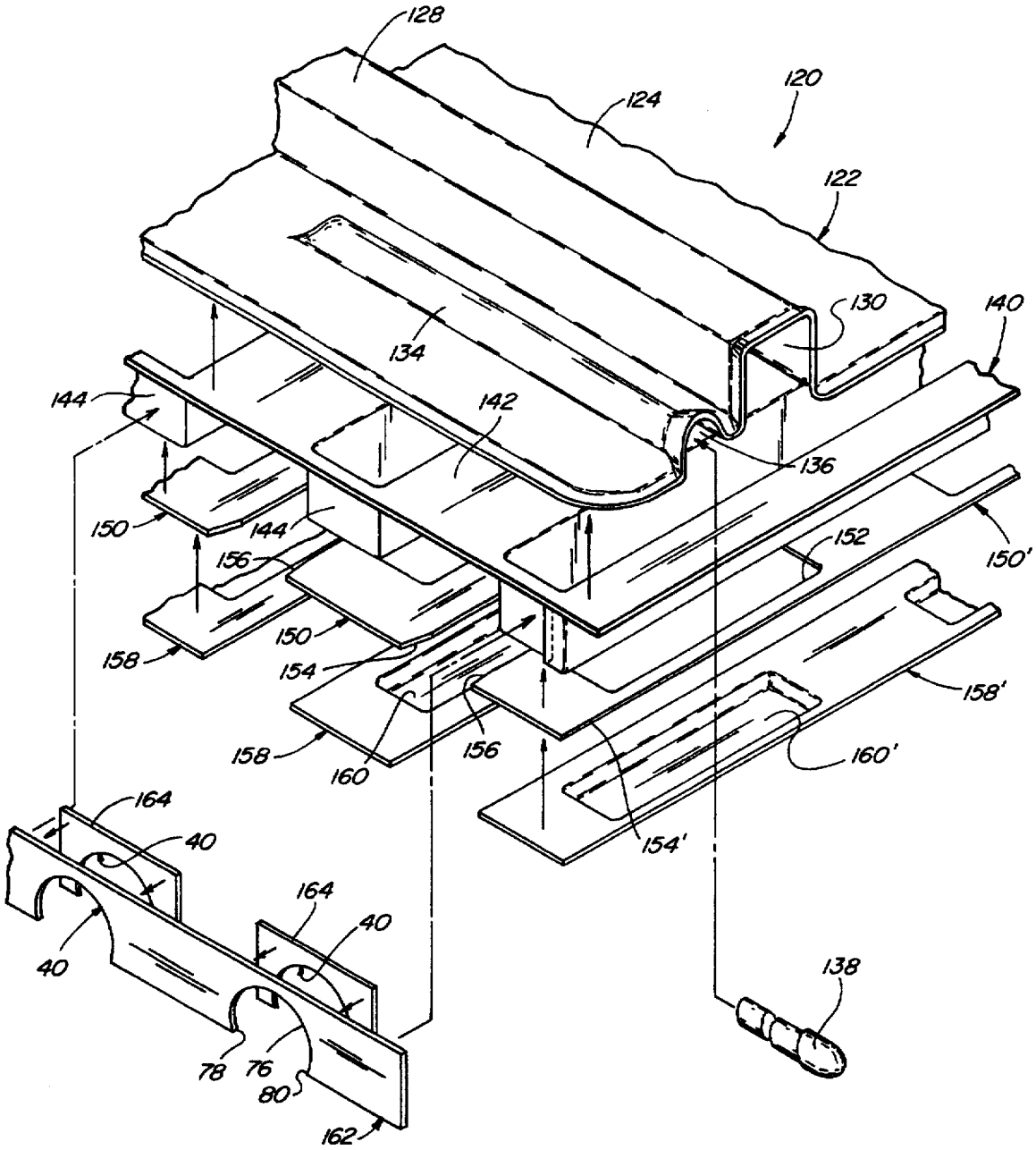
FIG. 19 is a fragmentary exploded perspective view of another embodiment of the present suspension type gravity feed product merchandising display device constructed according to the teachings of the present invention.
Figure 21:
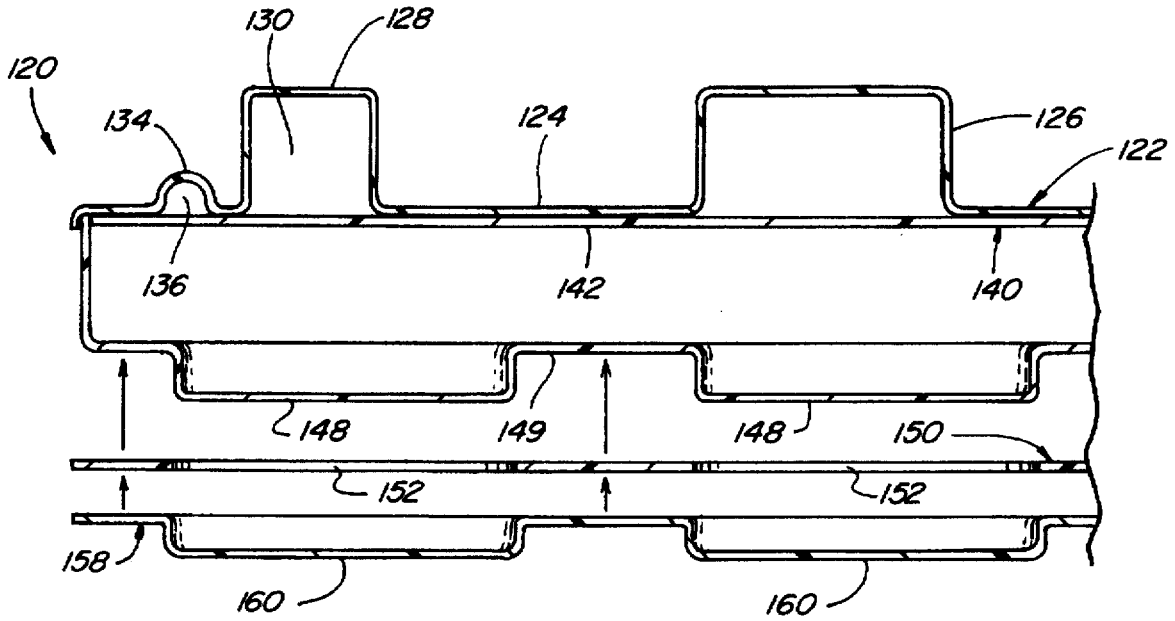
FIG. 21 is a fragmentary partially exploded side elevational view of the display device of FIGS. 19 and 20.
Figure 22:
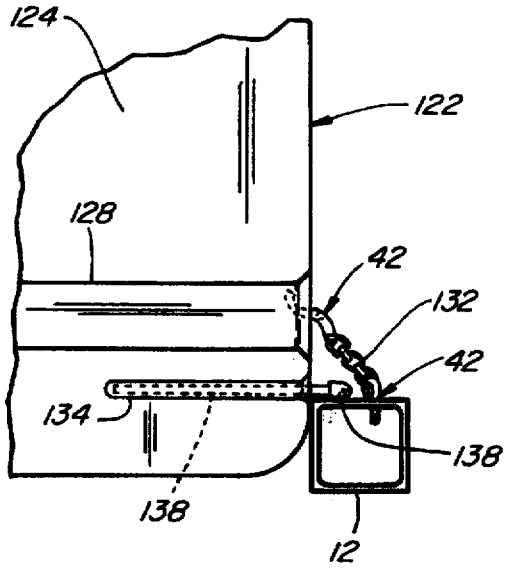
FIG. 22 is a fragmentary top planform view of a portion of the present display device illustrated in FIGS. 19–21 showing attachment of one portion of the present device to one of the front upright support members commonly associated with existing display equipment.

FIGS. 19–21 illustrate another embodiment of the present suspension type product merchandising display device constructed according to the teachings of the present invention. The present device 120 is again a layered composite structure formed by an upper member 122, a lower member 140, a plurality of members 150 forming the runner or rail members associated with each respective track, a plurality of elongated retaining members 158 for holding and securing the runner members 150 in proper position, and a stop member 162 positioned adjacent the front end portion of the device 120 so as to engage the closure portion of the forwardmost or lead product container in each product track similar to stop members 38, 96, 96' and/or 103 discussed above. The top or upper member 122 includes an upper surface 124 having a plurality of laterally extending spaced apart stiffening rib members 126 extending upwardly therefrom as best illustrated in FIGS. 20 and 21. The rib members 126 are similar to and function in the same manner as laterally extending rib members 28 associated with previously discussed embodiment 10. The top member 122 also includes a stiffening rib member 128 positioned and located at spaced locations from the respective front and rear edge portions of the member 122 (FIGS. 19–21), each lateral rib member 128 having an internal passageway 130 extending therethrough adaptable for receiving and holding one of the horizontal support bar members 44 and/or 44' illustrated in FIGS. 8 and 9. Similar to the construction and operation of support bar members 44/44' and rib members 28 housing passageways 84 as best illustrated in FIGS. 1 and 12, when the support bar members 44/44' are insertably positioned within the passageways 130 of rib members 128, each opposite end face 81 and 82 of each support bar member 44/44' will again be positioned and located in close proximity to one of the upright support members 12 as previously explained with respect to embodiment 10 and as shown in FIG. 22. Attachment of each opposite end face of the support bar members 44/44' to one of the upright support members 12 commonly associated with existing display equipment is accomplished in similar fashion as previously explained with respect to FIGS. 11 and 12, FIG. 22 further illustrating use of a chain or suspension cord member 132 in combination with a pair of hook members 42 for suspending the present device 120 from the upright support members 12 similar to the arrangement illustrated in FIG. 1. Although rib members 128 are illustrated in FIGS. 20 and 21 as being of a smaller cross-sectional shape as compared to stiffening rib members 126, it is recognized and anticipated that the size and shape of the respective rib members 126 and 128 as well as the size and shape of the support bar members 44/44' may take on a wide variety of different configurations so long as the passageway 130 associated with each rib member 128 is compatible for insertably receiving and holding the support bar member 44/44' when positioned therewithin. The top member 122 also includes an elongated projection member 134 having a passageway 136 extending therethrough, the passageway 136 being adaptable for insertably receiving a rod member or other suitable member such as the rod member 138 illustrated in FIGS. 19 and 22. A projection member 134 is positioned and located adjacent each opposite end portion of each rib member 128 at spaced locations from the respective front and rear portions of the member 122 as best illustrated in FIGS. 19 and 20, each elongated projection 134 extending laterally only partially across the width of the upper member 122 as illustrated. This means that an elongated projection member 134 is located at approximately the respective four corners of the upper member 122. When the present device 120 is assembled and suspended within existing display equipment in an operative gravity feed orientation as will be hereinafter explained, elongated rod members or other similar means such as the rod members 138 (FIGS. 19 and 22) are insertably positioned within the passageways 136 associated with the forwardmost projection members 134 only, the rod members 138 being dimensioned so as to extend or protrude beyond the opened end portion of passageway 136 as best shown in FIG. 22. When so positioned, the terminal end portions of the rod members 138 protruding from the projection members 134 will engage the rear portion of each of the front upright support members 12 thereby providing a stop mechanism for limiting and/or preventing the overall device 120 from swaying or otherwise moving forward during use. This arrangement stabilizes the overall device 120 within any particular display equipment when suspended therewithin since the weight of the product containers suspended therefrom will force and hold the rod members 138 in engagement with the front upright support members 12. In this regard, the length and size of the projection members 134, the passageways 136 and the rod members 138 can be varied depending upon the weight or load carrying capacity of the device 120 when fully loaded with the particular product containers to be dispensed therefrom. Only the pair of projection members 134 located adjacent the front portion of the particular display equipment into which the present device 120 is suspended are utilized as explained above to accomplish this further stabilization of the unit. It is also recognized and anticipated that projection members 134 and rod members 138 can be positioned and located to similarly engage the rear portion of one or both of the rear upright support members associated with any existing display equipment or other support structure. In addition, other means for limiting and/or preventing the overall device 120 from swaging or otherwise moving during use such as means positioned to engage the side portion of one or more of the upright support members 12 or other portions of the existing display equipment may also be utilized and are likewise contemplated.

Figure 23:
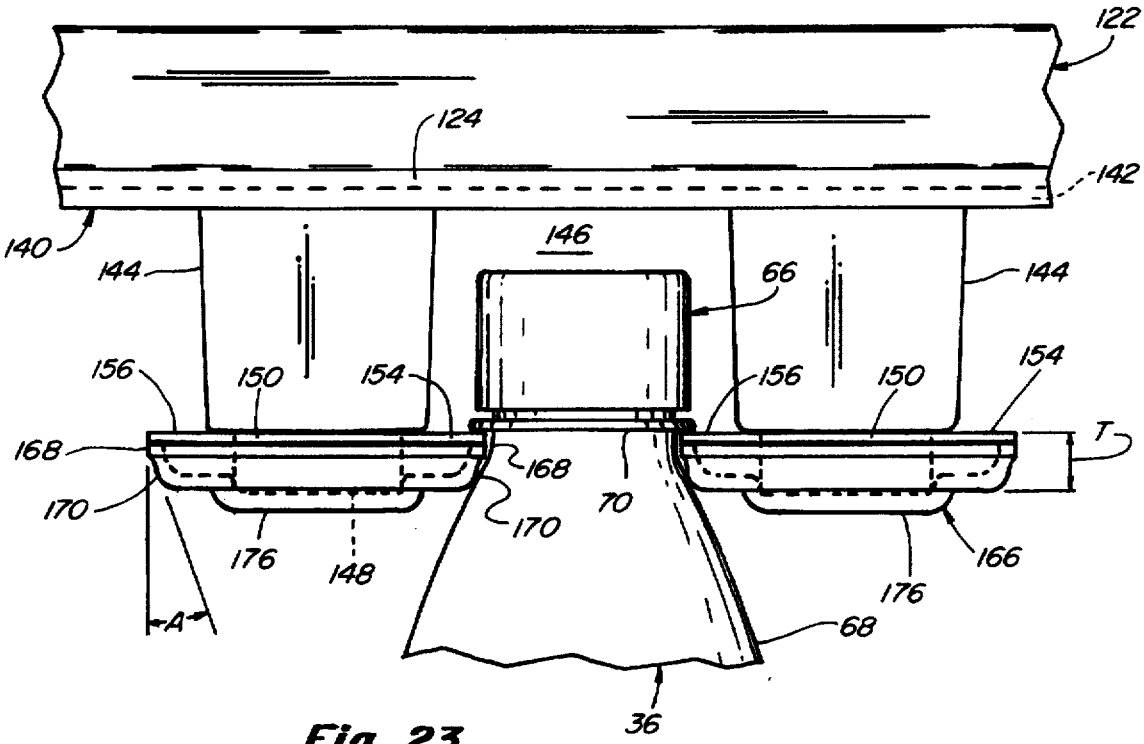
FIG. 23 is a fragmentary front elevational view of the display device of FIGS. 19 and 20 with the stop member removed showing another embodiment of the retainer member which may be utilized therewith.

The bottom or lower member 140 includes an upper surface 142 having a plurality of spaced apart downwardly extending substantially U-shaped fib or divider members 144 which extend longitudinally substantially the entire length of member 140 between the front and rear edge portions thereof as best illustrated in FIGS. 19 and 23. Rib members 144 not only provide strength and stability to the lower member 140 but such members also define therebetween a plurality of parallel product channels or tracks 146 as will be hereinafter further explained for supporting for slidable movement therewithin the closure portions of a plurality of bottles or other product containers such as the bottle 36 illustrated in FIG. 23. Each rib or divider member 144 also includes a plurality of longitudinally spaced projections 148 extending from front to rear between the opposed end portions thereof as best illustrated in FIGS. 21 and 23. These projection members 148 function as a means for engaging the respective rail or runner members 150 associated with each product channel or track 146 as will be hereinafter further explained.

As best illustrated in FIGS. 19 and 21, a plurality of rail forming members 150 are specifically designed for being sandwiched between the bottom wall surface 149 of each respective rib or divider member 144 and a corresponding retainer member 158. Each rail forming member 150 is substantially planar in construction and includes a plurality of openings 152 which are positioned and located so as to lie in registration with each projection member 148, each opening 152 being further sized and shaped so as to receive a corresponding projection 148 when the member 150 is positioned adjacent the bottom surface 149 of a respective divider member 144. When so positioned, the opposed side edge portions 154 and 156 of each respective rail forming member 150 extends respectively into the product channel or track 146 located on each opposite side of the particular divider member 144 to which the member 150 is attached, the side edge portions 154 and 156 defining the rail members upon which the closure portions of the product containers will slide. In this regard, the rail forming members 150 associated with the intermediate rib or divider members 144 are mounted and configured so as to extend into the corresponding product channels or tracks 146 on each opposite side thereof as illustrated. With respect to the rail forming members 150' mounted to the two outside divider members 144 adjacent the respective opposed side edge portions of the overall device 120, it should be noted that the overall width of these two outside rail forming members 150' has been shortened for obvious reasons since side edge portion 154' need not extend outwardly beyond the side periphery of the outside divider member 144 because there is no adjacent product channel or track 146 on that particular side for suspending bottles therefrom. In all other respects, the rail forming members 150 and 150' are substantially identical in both construction and function. Also, although it is preferred that the rail forming members 150 and 150' be fabricated from a metal material for strength, durability and longevity purposes, it is recognized and anticipated that such members can be fabricated from a wide variety of suitable materials including a wide variety of different plastic materials.

Once the rail forming members 150 and 150' are properly positioned against the respective bottom wall surfaces 149 of each divider member 144, such members are securely held thereagainst through the use of a plurality of elongated retainer members 158 as best illustrated in FIGS. 19 and 21. Each retainer member 158 includes a plurality of longitudinally spaced recessed cavities 160, each cavity 160 being positioned and located so as to likewise lie in registration with the downwardly extending projections 148 associated with divider members 144, the cavities 160 being further sized and shaped so as to cooperatively receive the corresponding projections 148 when positioned thereagainst. The retainer members 158 can be fixedly attached to the members 150 and 150' by any suitable means of joinder such as through the use of adhesives, fasteners, or other mechanical means. If adhesives are used to accomplish this task, the cooperative engagement between the downwardly extending projections 148 and the recessed cavities 160 provide suitable bonding surfaces for joinder. In this regard, it is also recognized and anticipated that the rail forming members 150 and 150' may likewise be fixedly attached to the bottom wall surface 149 of each respective divider member 144 using any suitable means of joinder. Like the outside rail forming members 150', the outside retainer members 158' positioned adjacent the opposed side edge portions of the overall unit 120 are likewise shorter in overall width for the same reasons discussed above with respect to members 150'. Once the members 140, 150, 150', 158 and 158' are joined together, the top member 122 can thereafter be joined to the bottom member 140 as illustrated in FIG. 20 again using any suitable means of joinder such as adhesives or ultrasonic welding. When so joined, the passageways 130 and 136 associated respectively with rib members 128 and projection members 134 are closed along their respective bottom portions by the upper surface 142 of bottom member 140 as illustrated in FIG. 21. The passageways 130 and 134 are now ready to insertably receive their respective members 44/44' and 138. Importantly, rail forming members 150 and 150' can be provided in differing widths as measured between the opposed edge portions 154 and 156 of adjacent members extending into the same product channel or track 146 so as to control the spacing therebetween to accommodate product containers having differently sized neck and closure portions as previously explained. In this regard, rail forming members 150 and 150' can be provided in differing predetermined widths corresponding to the different widths of the upper portions of a wide variety of product containers. It is also recognized and anticipated that any one of the optional elongated adapter strip members 108, 110 and 112 illustrated in FIGS. 16–18 may likewise be utilized in conjunction with rail members 154 and 156 to adjust the lateral spacing between opposed rail members in any particular track 146 in order to engage the closure portion of the particular sized product container suspended therewithin.

Like embodiment 10 illustrated in FIGS. 1–7, the present device 120 likewise includes a stop member 162 which is attachable adjacent the front end portion of the composite device 120 as best illustrated in FIGS. 19 and 20. Stop member 162 is shown as being a one-piece member having a plurality of apertures 40 associated therewith, each aperture 40 being positioned and located so as to lie in communication with each respective product channel or track 146 associated with the device 120. The apertures 40 associated with stop member 162 including the opposed terminal ends 78 and 80 associated with peripheral edge portion 76 are substantially identical in construction and operation to the apertures 40 associated with stop members 38 and 96 discussed above with respect to FIGS. 4–6 and 14. As explained with respect to embodiment 10 illustrated in FIGS. 4–6, arrestment and removal of a bottle or product container 36 from the device 120 operates in a similar fashion. In order words, a bottle 36 can be easily removed from track 146 by simply grasping bottle 36 and pivoting or angularly rotating the same about its closure portion such that neck portion 68 passes between the terminal edge portions 78 and 80 of stop member 162 and thereafter easily and conveniently pulling the closure portion 66 of the bottle 36 forwardly through the aperture 40 as illustrated in FIG. 6. A bottle 36 can pass through the aperture 40 when such bottle is oriented at at least the minimum predetermined angle with respect to its free state orientation as previously explained and illustrated in FIGS. 4 and 5.

Although stop member 162 is shown as a one-piece member, it is recognized and anticipated that stop member 162 can be fabricated similar to stop members 38, 96, 96' and 103. All changes, modifications and optional alternative stop member constructions discussed above and illustrated in FIGS. 14, 15A and 15B are likewise equally applicable to the construction and operation of stop member 162. Similarly, all of the various means for changing the size of at least a portion of the aperture 40 associated with stop member 162 for accommodating product containers having differently sized neck and closure portions previously discussed above are likewise equally applicable including varying the spacing between the aperture terminal edge portions 78 and 80 of stop member 162. Additionally, as previously explained, it is also recognized and anticipated that an additional stop member may be positioned adjacent the rear end portion of each respective track 146, this rear stop member being constructed substantially similar to the stop member utilized adjacent the front portion of the unit such as stop member 162 thereby facilitating installation, loading and product removal since, in this configuration, products can be both loaded and removed from either end of the respective tracks 146.

As illustrated in FIG. 19, an optional backing plate member 164 may be positioned within each product channel or track 146 adjacent the corresponding back surface of stop member 162, each backing plate member 164 including an identical aperture 40 which mates and aligns with each respective aperture 40 associated with stop member 162 when positioned thereagainst. The plating member 164 functions to reduce wear and tear on the respective apertures 40 associated with the stop member 162 as well as to provide additional support and strength thereto particularly during the bottle removal process. In this regard, it is preferred that the backing plate members 164 be made of a metal material, although other materials will likewise achieve the stated objective. The plate members 164 can be easily fixedly attached to the back surface of stop member 162 using any suitable means of joinder such as a wide variety of suitable adhesives. It is also anticipated that the size of the aperture associated with each plate member 164 can be varied as previously discussed with respect to FIGS. 14, 15A and 15B so as to accommodate product containers having a plurality of differently sized neck and closure portions.

Figure 24:
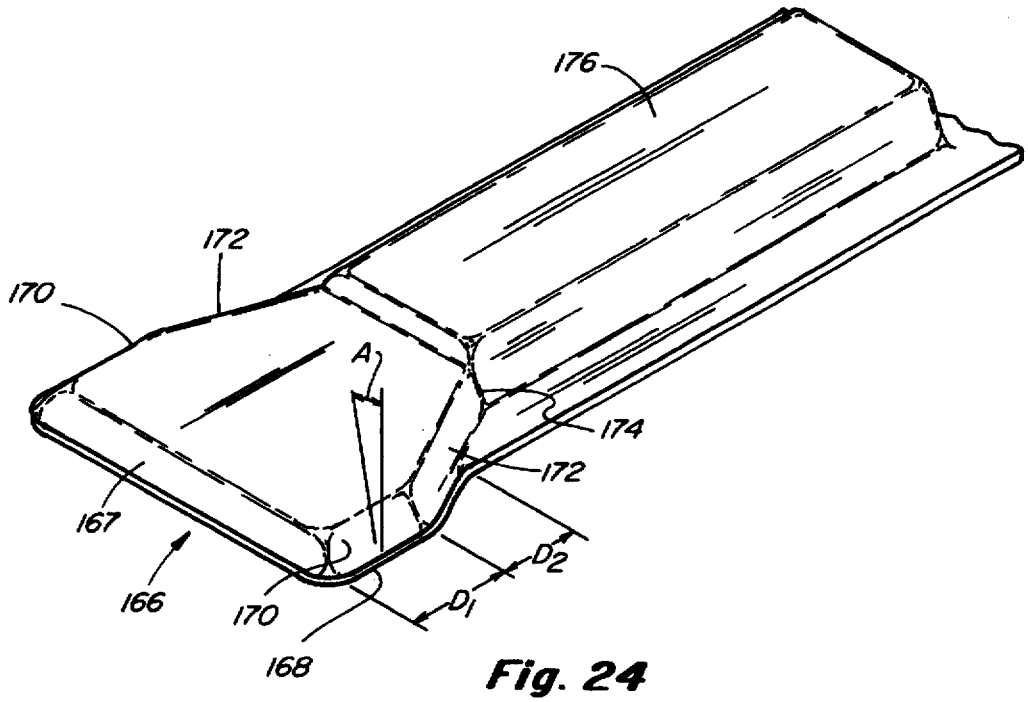
FIG. 24 is a partial perspective view of the bottom front portion of the retainer member illustrated in FIG. 23.

FIGS. 23 and 24 illustrate another embodiment 166 of retainer member 158 wherein each respective front side edge portion of the member 166 includes tapered or beveled portions 170 and 172 as best illustrated in FIG. 24. Each side edge front wall portion includes a substantially straight or vertical portion 168 and a portion 170 which is angularly related thereto as best illustrated in FIG. 23. Tapered side edge portion 170 forms an angle "A" with side wall portion 168 and extends rearwardly from the front edge portion thereof a distance "$D_1$" as illustrated in FIG. 24. The tapered edge portion 172 extends both rearwardly and inwardly towards edge portion 174 as illustrated in FIG. 24. This angularly oriented taper 172 extends from one end portion of tapered surface 170 a distance "$D_2$" as illustrated. This double tapered arrangement functions both as a deceleration mechanism for the lead product container moving forwardly within the product channel or track 146 as well as a control mechanism for controlling the amount of forward tilt which will be imparted to the lead product container when it comes to rest against the stop member 162. As the angle "A" increases, the amount of forward tilt imparted to the lead product container will likewise increase. As a result, the free state orientation of the lead product container can be effectively controlled depending upon the size and configuration of the product containers utilized within each product track 146. Although the length of the rearward extension of the tapered surfaces 170 and 172 is not substantially critical, the total length "$D_1$"+"$D_2$" should be at least equal to approximately the diameter of the cap or closure portion associated with the particular product containers being suspended within a particular product channel 146. On the other hand, the thickness "T" of the front side edge portions of the retainer members 166 as best illustrated in FIG. 23 is critical in that as the thickness or depth "T" increases, the more the forward side edge portions of the member 166 will catch or make contact with the neck portion 68 of bottle 36 thereby increasing the deceleration effect. Also, as shown in FIGS. 23 and 24, the front portion 167 of the retainer member 166 is flared outwardly on each opposite side thereof as shown. This flared arrangement allows the side edge portion of the respective rail members 154 and 156 positioned adjacent to the side edge from wall portion 168 to lie substantially flush therewith thereby ensuring that the neck portion 68 of bottle 36 will make contact with tapered side edge portions 172 and/or 170 as the bottle 36 approaches the stop member 162. In all other respects, the construction of the retainer member 166 is substantially identical to the construction of retainer member 158 including having a plurality of spaced recessed cavities 176 associated therewith. In similar fashion, the outside retainer members 166' can be constructed similar to outside retainer members 158'.

It is also important to note that since the upper member 122 includes a pair of elongated projection members 134 located at spaced locations from the respective front and rear portions of the top member 122, if stop members such as the members 38 and/or 162 are positioned adjacent the rear end portion of the present device 120, the present device 120 likewise becomes reversible and the front and rear portions of the device 120 are again interchangeable as previously discussed with respect to embodiment 10. This means that the present device 120 can be mounted within existing equipment with either end portion extending towards the front of the unit, the protruding rod members 138 being utilized with the pair of projection members 134 located with that end portion of the device 120 extending towards the front of the existing display equipment.

Figure 25:
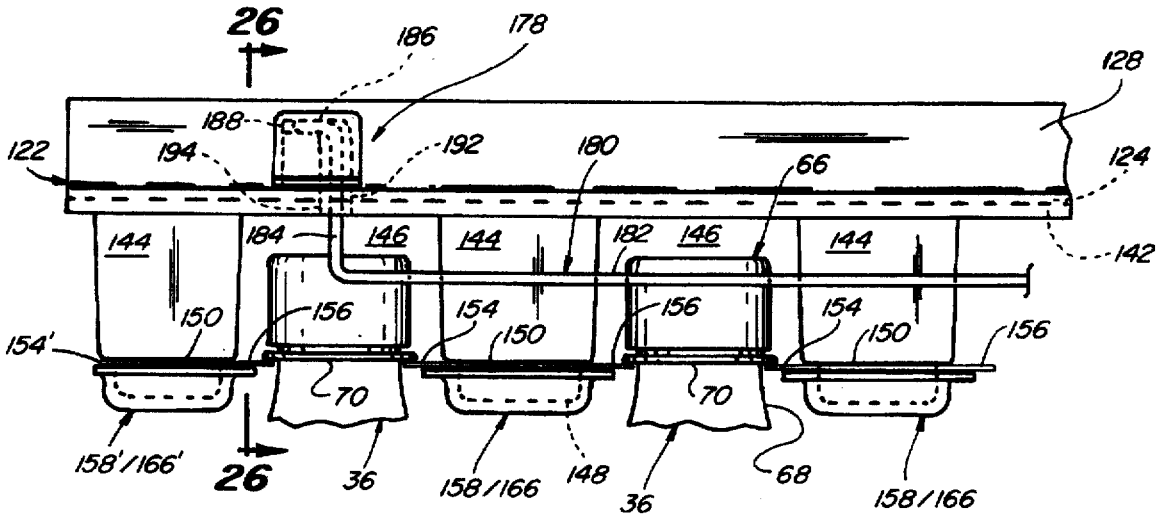
FIG. 25 is a fragmentary rear elevational view of the display device of FIGS. 19 and 20 showing an optional one-way rear stop mechanism which may be utilized with any embodiment of the present display device.
Figure 26:
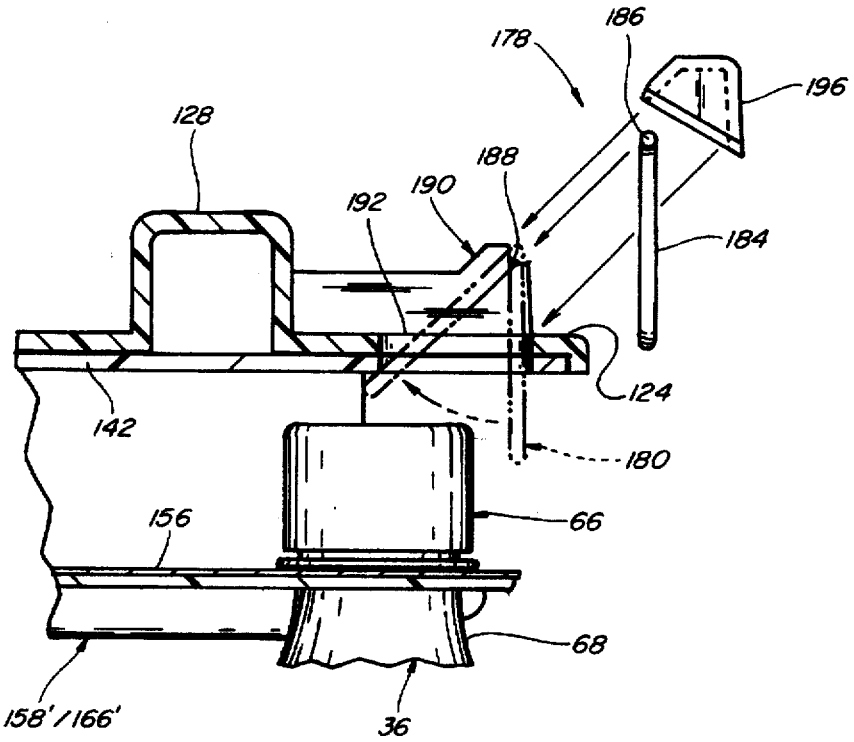
FIG. 26 is a partial cross-sectional exploded view of the display device of FIG. 25 taken along line 26—26 showing the installation and movement of the stop mechanism illustrated in FIG. 25.

FIGS. 25 and 26 illustrate an optional rear stop mechanism 178 which may be incorporated into any of the embodiments of the present display device such as embodiments 10 and 120 disclosed herein. More particularly, rear stop mechanism 178 includes a substantially U-shaped rod member having a center or cross portion 182 and spaced parallel or substantially parallel leg portions 184 extending upwardly from the opposite ends portions thereof as best shown in FIG. 25. Each upwardly extending leg portion 184 likewise includes an outwardly extending portion 186 which lies substantially parallel to the center cross portion 182. As best shown in FIG. 26, the outwardly extending rod end portions 186 are positioned and located within a groove, notch or slot 188 formed in a flange or projection member 190 which extends upwardly from the surface 124 associated with top member 122. In this regard, the surfaces 124 and 142 associated respectively with top member 122 and bottom member 140 each include a slot or opening such as the slots 192 and 194 illustrated in FIGS. 25 and 26, the slots 192 and 194 being sized and dimensioned so as to both receive the rod portions 184 and 186 and to allow the pivotal movement of the rod member 180 as illustrated in FIG. 26. The slots 192 and 194 are positioned and located adjacent each respective flange or projection member 190 in such a manner as to enable the rod member 180 to pivotally swing inwardly as illustrated. The slots 192 and 194 may be L-shaped in configuration, or they may take on a wide variety of other configurations so long as such slots allow the rod member 180 to pivotally swing as illustrated in FIG. 26.

The rear stop mechanism 178 also includes a cap member 196 which is removably attachable to the flange or projection member 190 once the rod end portions 186 are positioned and located within the groove or notch 188. The cap member 196 may be removably attachable to the flange or projection member 190 by any suitable means such as by a snap-on friction type engagement and functions to securely hold the rod end portions 186 in proper position within the respective grooves or notches 188 during use. When so assembled, the rod member 180 extends across at least a portion of each of the various product channels as illustrated in FIG. 25 thereby providing a means for both controlling the loading of product containers from the rear of the unit and, at the same time, preventing such product containers from exiting or otherwise being forced out of the rear of the unit. Importantly, the rod member 180 is free to pivotally rotate inwardly as shown in FIG. 26 in response to a force exerted thereagainst in a direction towards the product channel from the rear thereof. This allows product containers to be easily loaded within each product channel 146 from the rear portion of the device. In this regard, the rod member 180 must rotate inwardly a sufficient amount as illustrated in FIG. 26 such that the cap or closure portion 66 associated with any particular product container will freely slide within the respective product channel 146 without any interference from the rod member 180. In total contrast, the rod member 180 is prevented from swinging outwardly or rearwardly towards the rear edge portion of the device due to the fact that the slots 192 and 194 engage and stop the rod portions 184 from pivotally rotating in a rearward direction. This one-way pivotable rear stop mechanism is advantageous in that, although it freely allows product containers to be loaded or re-stocked from the rear of the unit, importantly, such mechanism prevents the product containers from exiting the rear of the unit when the present devices are loaded or re-stocked from the front thereof. Any suitable biasing means may also be utilized to hold or bias the rod member 180 in its closed position preventing product containers from exiting the rear of the unit.

Although FIGS. 25 and 26 illustrate the attachment of only one end portion of the rod member 180 with a corresponding flange or projection member 190, it is recognized that the opposite end portion of the rod member 180 is similarly configured and attached to a corresponding flange or projection member 190. In this regard, although the rod portion 182 can extend across at least a portion of all of the product channels 146 associated with any particular device, it is also anticipated that a plurality of stop mechanisms 178 can be utilized to span any plurality of product channels 146 associated with a particular unit. For example, if a particular device such as the embodiment 10 illustrated in FIG. 1 includes nine product channels or tracks, it is contemplated that three separate rear stop mechanisms 178 may be utilized to extend across the nine product channels, one rear stop mechanism 178 extending across each respective set of three product channels. In this particular construction, a plurality of flange members 190 would be positioned and located in spaced apart relationship across the rear portion of the device as previously explained, each pair of flange or projection members 190 being positioned and located such that the rod member 180 attached respectively thereto will span across at least a portion of three product channels. In such an arrangement, it is also anticipated and recognized that any pair of adjacent flange members 190 located at an intermediate location between the opposite side edge portions of any particular device may be replaced by a single flange member 190, the single flange member 190 having a notch or groove 188 sized and shaped so as to receive opposed rod end portions 186 associated with adjacent rod members 180. Still further, it is also recognized and anticipated that the specific shape and configuration of the rod member 180 as well as the flange or projection members 190 are subject to wide variations and may take on a wide variety of different sizes and configurations without impairing the stated objective of providing a one-way rear stop mechanism. Also, it is further recognized that any suitable means for pivotally attaching the rod member 180 to any embodiment of the present device may be utilized without impairing the teachings and practice of the present invention.

It is also recognized and anticipated that the present devices 10 and 120 can be fabricated so as to include any number of product channels or tracks such as the product tracks 34 and 146, including a single track, and that such devices can be easily suspended and/or connected together in side-by-side relationship to form a multiplicity of different columnar arrangements depending upon the number and width of the various product tracks needed for a particular application. In this regard, the resulting suspension type gravity feed product merchandising display devices may comprise a plurality of product modules which can be assembled in columnar array to achieve any desired width and any desired number of product channels or tracks depending upon the particular merchandising application. Each product module can be laterally positioned and suspended in abutting side-by-side relationship to adjacent product modules so as to form an overall assembly for suspending products in a columnar array. The product modules may also be laterally interlocked or otherwise connected together in side-by-side relationship to form a more stabilized assembly. In either case, each product module preferably includes at least one product channel or track for suspending products positioned therewithin, it being contemplated that the respective product channels or tracks may vary in lateral width not only to accommodate product containers of different dimensions but also due to the fact that some product modules may include more product channels or tracks as compared to others. The construction of the various product modules as just described enables any number of such modules to be positioned adjacent each other in any preferred number to form a particular display device which not only conveniently fits in the allotted space within existing display equipment, but also includes the maximum number of product channels or tracks for the particular type of product containers to be merchandised therefrom. This is true whether the lateral width of each such product channel or track is the same or of varying widths. Such product modules also provide effective means for selectively adjusting the overall width of the present devices to accommodate the multitude of varying sizes and different types of refrigerated display coolers, cold vaults, and other display support structures presently in use. Regardless of the number of product channels or tracks associated with any particular product module, each product channel or track is constructed as disclosed and described above with respect to the product tracks 34 and 146 associated respectively with embodiments 10 and 120 of the present invention.

In addition, the overall dimensions of the present devices 10 and 120 as well as the specific shape and configuration of the various members comprising the present structures such as the upper members 46 and 122, the lower members 48 and 140, the divider members 144, the retainer members 158, 158', 166 and 166', and the suspension means 42, 44, 44' and 132 are all subject to wide variations and may be sized and shaped into a variety of different sizes and configurations so as to be compatible with the size and shape of the particular product merchandising display equipment into which the present structures 10 and 120 may be mounted, or to conform with any other space limitation, without impairing the teachings and practice of the present invention. Other variations and modifications to the various components comprising the present structures are also contemplated.

Thus there has been shown and described several embodiment of a novel gravity feed product merchandising display device and method for manufacture of same which is mountable in place of existing gravity feed shelf members in association with various product display units including refrigerated coolers and the like, which device fulfills all of the objects and advantages sought therefor. Many changes, modifications, variations and other uses and applications of the present invention will, however, become apparent to those skilled in the art after considering this specification and the accompanying drawings. All such changes, modification, variations and other uses and applications which do not depart from the spirit and scope of the invention are deemed to be covered by the invention which is limited only by the claims which follow.

What is claimed is:

1. A gravity feed product merchandising display device comprising at least one track having opposed front and rear end portions for supporting in single file a plurality of similar product containers of the type having a neck portion and a closure portion, the closure portion of each product container having portions thereof extending outwardly from the neck portion, each track further including a pair of elongated rail members spaced apart to receive therebetween the necks of suitably sized product containers such that at least an edge portion of the closure portion of each such product container engages said rail members whereby the product containers are suspended by their closure portions for movement relative to said rail members, each track being inclinable towards their respective front end portions so as to allow the suspended product containers to gravity feed one after the other to the front thereof as the lead container in each row is successively unloaded, and a stop member positioned adjacent to the front end portion of each pair of rail members forming each respective track so as to stop the forward movement of each lead product container suspended thereon, said stop member having a generally forwardly facing aperture therethrough located in communication with the space defined between and above each respective pair of rail members, said stop member having a peripheral edge portion defining at least a portion of said aperture, said peripheral edge portion being sized and shaped to allow the neck of each product container to pass relatively freely through said aperture but preventing passage of the product container closure portion therethrough when the product containers are oriented in their free state orientation, the aperture of said stop member being further sized and shaped so as to allow the closure portion of each product container to pass therethrough when the product container is angularly oriented at at least a minimum predetermined angle relative to its free state orientation.

2. The product merchandising display device defined in claim 1 including means for changing the size of at least a portion of said aperture for accommodating product containers having differently sized neck and closure portions.

3. The product merchandising display device defined in claim 2 wherein said means includes a second stop member positioned in overlaying relationship to said first named stop member, said second stop member having a peripheral edge portion defining at least a portion of an aperture therethrough which is smaller than the corresponding portion of the aperture associated with said first named stop member.

4. The product merchandising display device defined in claim 1 wherein said stop member is removably positionable adjacent the front end portion of each respective track.

5. The product merchandising display device defined in claim 4 including a plurality of removably positionable stop members, each of said plurality of stop members having an aperture extending therethrough, each of said apertures being of a size and shape so as to accommodate product containers having differently sized neck and closure portions.

6. The product merchandising display device defined in claim 1 including a pair of elongated strips and means for attaching said strips in at least partial overlaying relationship to a pair of said rail members so as to reduce the space between said rail members to enable the suspension of product containers having smaller sized closure portions.

7. The product merchandising display device defined in claim 6 wherein said elongated strips are L-shaped in cross-section.

8. The product merchandising display device defined in claim 6 wherein said elongated strips are U-shaped in cross-section.

9. The product merchandising display device defined in claim 1 wherein said stop member is positioned adjacent the front end portion of each respective track such that its upper portion is located more forward as compared to its lower portion to further facilitate removal of product containers from each respective track.

10. The product merchandising display device defined in claim 1 including an additional stop member positioned adjacent to the rear end portion of each pair of rail members forming each respective track, said additional stop member being constructed substantially similar to said first named stop member.

11. The product merchandising display device defined in claim 1 wherein the aperture associated with said stop member is sized and shaped so as to conform to the size and shape of the closure portion of the bottles positioned therethrough.

12. The product merchandising display device defined in claim 1 wherein the minimum predetermined angle is in the range from about 50° to about 100°.

13. The product merchandising display device defined in claim 1 wherein said device comprises a series of tracks positioned together in side by side relationship.

14. The product merchandising display device defined in claim 1 wherein said device is positioned within a support structure having a plurality of substantially upright support members associated therewith, said device further including means engageable with at least one of said upright support members for limiting the forward movement of said device when positioned within said support structure.

15. The product merchandising display device defined in claim 1 including a substantially planar member positioned within each respective track adjacent said stop member, each of said planar members having an aperture extending therethrough which is substantially similar to the aperture extending through said stop member, the aperture associated with said planar member being located adjacent to and aligning with the aperture associated with said stop member when said planar member is positioned within a respective track.

16. The product merchandising display device defined in claim 1 including means for controlling the amount of forward tilt imparted to the lead product container in any respective track when the lead product container comes to rest adjacent said stop member.

17. The product merchandising display device defined in claim 1 including means for decelerating the lead product container as it moves forward within a respective track and approaches said stop member.

18. The product merchandising display device defined in claim 1 including means for suspending said device within an existing display unit.

19. The product merchandising display device defined in claim 1 including a substantially planar member positioned within each respective track adjacent said stop member, each of said planar members having an aperture extending therethrough which is sized differently as compared to the aperture extending through said stop member, the aperture associated with said planar member being located adjacent to and aligning substantially with the aperture associated with said stop member when said planar member is positioned within a respective track.

20. A gravity feed product display device for merchandising a plurality of bottles in parallel rows, the bottles each including a neck portion and an outwardly extending closure portion located thereabove, said device comprising a plurality of elongated channel divider members positioned in spaced apart parallel relationship to each other defining therebetween a plurality of parallel channels, each of said channels being defined by a pair of said divider members and each being of sufficient size to receive the closure portion of a plurality of bottles when positioned therewithin, the pair of channel divider members defining each respective channel each including a rail member extending into the channel formed thereby along substantially the entire length thereof, each of said pair of rail members extending into each respective channel being located in spaced apart, opposed relationship to each other and each being dimensioned so as to engage the closure portions of a row of bottles positioned therebetween whereby the bottles are suspended from the bottle closure portions for slidable movement along said rail members, said device being positionable with said rail members inclined towards one end thereof so as to allow the suspended bottles to gravity feed one after the other towards said one end as the endmost bottle in each channel is successively removed, and a stop member positioned adjacent said one end of each of said pairs of rail members, each stop member having a generally endwardly facing opening therethrough positioned and located in registration with the end of each of said channels, each stop member opening being sized and shaped to engage the closure portion of the endmost bottle so as to prevent its passage through said opening when the bottle is oriented in its suspended free state orientation, each stop member opening being further sized and shaped so as to allow passage of the closure portion of the endmost bottle through said endwardly facing opening when the endmost bottle is angularly oriented at at least a minimum predetermined angle relative to its suspended free state orientation.

21. The product display device defined in claim 20 wherein said plurality of channels defined by said elongated channel divider members are spaced apart and are joined together by rib members extending respectively therebetween at spaced locations along the respective lengths thereof.

22. The product display device defined in claim 20 including a generally planar member having first and second opposed surfaces, said channel divider members being affixed to the first opposed surface of said planar member, and at least one relatively rigid stiffening member affixed to the second opposed surface of said planar member.

23. The product display device defined in claim 22 wherein said stiffening member is a member having a corrugated cross-section.

24. The product display device defined in claim 23 wherein said stiffening member comprises a grid of intersecting corrugated portions.

25. The product display device defined in claim 20 wherein each stop member includes a peripheral edge portion defining at least a portion of said endwardly facing opening, said peripheral edge portion engaging the closure portion of the endmost bottle at spaced locations around the periphery thereof when the endmost bottle is in its suspended free state orientation.

26. The product display device defined in claim 20 wherein the minimum predetermined angle is about 50°.

27. The product display device defined in claim 20 wherein each of said stop members are incorporated into a single stop member, said single stop member having a plurality of endwardly facing openings associated therewith, each of said stop member openings being positioned and located in registration with the end of each of said channels.

28. The product display device defined in claim 20 wherein said device includes first and second members, said plurality of elongated channel divider members being located on said first member, said second member including a plurality of spaced apart rib members extending thereacross, said first and second members being joined together to form at least a portion of said device.

29. The product display device defined in claim 28 wherein said rail members are attachable to said divider members.

30. The product display device defined in claim 28 wherein said device is positionable within an existing display structure, said second member including means for limiting the forward movement of said device when positioned within said existing display structure.

31. The product display device defined in claim 28 including means on said first member for controlling the amount of forward tilt imparted to the lead bottle in any respective channel when the lead bottle comes to rest adjacent said stop member.

32. A gravity feed product merchandising display device comprising at least one track having opposed front and rear end portions for supporting in single file a plurality of similar product containers of the type having an annular flange on the neck portion of the container, each track further including a pair of elongated rail members spaced apart to receive therebetween the necks of suitably sized product containers such that the underside of each product container flange engages said rail members whereby the product containers are suspended by their flanges for movement relative to said rail members, each track being inclinable towards their respective front end portions so as to allow the suspended product containers to gravity feed one after the other to the front thereof as the lead container in each row is successively unloaded, the product containers when suspended from said rail members in their free state having a generally upright orientation, and a stop member positioned adjacent to the front end portion of each pair of rail members forming each respective track so as to stop the forward movement of each lead product container suspended thereon, said stop member having a generally forwardly facing aperture therethrough located in communication with the space defined between and above each respective pair of rail members, said stop member having a peripheral edge portion defining at least a portion of said aperture, said peripheral edge portion being sized and shaped to allow the neck of each product container to pass relatively freely through said aperture but preventing passage of the container annular flange therethrough when the product containers are oriented in their free state orientation, the aperture of said stop member being further sized and shaped so as to allow the annular flange of each product container to pass therethrough when the product container is angularly oriented at at least a minimum predetermined angle relative to its free state orientation.

33. The product merchandising display device defined in claim 32 wherein the minimum predetermined angle is about 50°.

34. The product merchandising display device defined in claim 32 wherein said device comprises a series of tracks arranged in side by side relationship.

35. A method for manufacturing a gravity feed product merchandising display device wherein a plurality of product containers are suspended therefrom in parallel rows for easy removal therefrom, said product containers each including a neck portion and a closure portion, the closure portion of each product container having portions thereof extending outwardly from the neck portion, said method comprising:

(a) forming a layered composite structure having at least one outwardly facing member including a plurality of parallel, elongated rib members, each rib member being defined by at least a pair of parallel, spaced apart side wall portions attached along one edge thereof to a bottom wall portion extending therebetween;

(b) defining an intermediate portion of each of the bottom wall portions of said elongated rib members, said intermediate portions being spaced from both side wall portions forming each respective rib member; and (c) removing the intermediate portion of each of said bottom wall portions forming said rib members such that the side wall portions and the remaining bottom wall portions of each respective rib member form spaced, opposed pairs of L-shaped members, each pair of opposed L-shaped members defining a channel therebetween adaptable for receiving the neck and closure portions of a row of product containers positioned therebetween, said remaining bottom wall portions defining rails adaptable for engaging and supporting at least an edge portion of the closure portion of each product container positioned within each respective channel for slidable movement therealong.

36. The method defined in claim 35 wherein said layered composite structure further includes a substantially planar member and a stiffening member, said substantially planar member being positioned between said at least one outwardly facing member and said stiffening member.

37. The method defined in claim 35 wherein said stiffening member comprises a grid of intersecting rib members.

38. A gravity feed product display device for suspending a plurality of product containers in parallel rows therefrom, the product containers being of the type having a neck portion and a closure portion, the closure portion of each product container having portions thereof extending outwardly from the neck portion, said display device comprising a plurality of divider members positioned in spaced apart relationship defining therebetween a plurality of product channels, each product channel being of sufficient size to receive the closure portion of a product container when positioned therewithin, a planar member having opposed side edge portions attachable to each of said divider members, the side edge portions of each planar member extending respectively into the product channel located on each opposite side of the divider member to which it is attached, said planar member side edge portions defining rail members, each of said pair of rail members extending into each respective product channel being located in spaced apart, opposed relationship to each other and each being dimensioned so as to engage the closure portions of a row of product containers positioned therebetween whereby the product containers are suspended from their respective closure portions for slidable movement along said rail members, said display device being positionable with said product channels inclined towards one end thereof so as to allow the suspended product containers to gravity feed one after the other towards said one end as the lead product container in each product channel is successively removed, and a stop member positioned adjacent said one end of each of said product channels, said stop member including a plurality of generally forwardly facing apertures extending therethrough, each of said stop member apertures being positioned and located so as to lie in registration with each of said product channels, each stop member aperture being sized and shaped to engage the closure portion of the lead product container so as to prevent its passage through said aperture when the product container is oriented in its suspended free state orientation, each stop member aperture being further sized and shaped so as to allow the closure portion of each product container to pass therethrough when the product container is angularly oriented at at least a minimum predetermined angle relative to its suspended free state orientation.

39. The product display device defined in claim 38 wherein each of said planar members include at least one opening extending therethrough, each of said divider members including at least one projecting portion extending therefrom, the number of projecting portions associated with each of said divider members corresponding in number to the number of openings extending through each of said planar members, each of said projecting portions being positioned and located so as to extend into the openings associated with a planar member when said planar member is attached to said divider member.

40. The product display device defined in claim 39 including a retainer member engageable with each of said divider members, each of said retainer members including at least one recessed cavity, the number of recessed cavities associated with each of said retainer members corresponding in number to the number of projecting portions associated with each of said divider members, each of said recessed cavities being positioned and located so as to cooperatively receive the projecting portions associated with a divider member when said retainer member is positioned thereagainst, said retainer members being attachable to said divider members to further secure said planar members in proper position thereagainst.

41. The product display device defined in claim 40 wherein each of said retainer members includes means for controlling the mount of forward tilt imparted to the lead product container in any respective product channel when the lead product container comes to rest adjacent said stop member.

42. The product display device defined in claim 38 wherein said device is positionable within an existing support structure, said device further including means for limiting the forward movement of said device when positioned within said support structure.

43. The product display device defined in claim 42 wherein the existing support structure into which said device is positioned includes a plurality of substantially upright support members, said means for limiting the forward movement of said device when positioned within said support structure including at least one rod member engageable with at least one of said upright support members.

44. The product display device defined in claim 38 including means for suspending said device within an existing support structure.

45. The product display device defined in claim 38 wherein the minimum predetermined angle is about 50°.

46. The product display device defined in claim 38 wherein said device includes a plurality of spaced apart rib members for providing strength and rigidity to said device.

47. The product display device defined in claim 38 including additional stop means positioned and located adjacent the opposite end of at least a portion of said product channels for controlling access to said product channels from said opposite end, said additional stop means being rotatably movable between a first closed position wherein said additional stop means extend across at least a portion of the corresponding product channels preventing the product containers positioned within said product channels from exiting the opposite end thereof and a second open position angularly related thereto for admitting product containers within said product channels from said opposite end, said additional stop means being movable to its second open position in response to a force exerted thereagainst in a direction towards the lead product container in each product channel.

48. A method for manufacturing a gravity feed product merchandising display device wherein a plurality of product containers are suspended therefrom in parallel rows for easy removal therefrom, said product containers each including a neck portion and a closure portion, the closure portion of each product container having portions thereof extending outwardly from the neck portion, said method comprising:

(a) forming a layered composite structure having at least one outwardly facing member including a plurality of parallel, elongated rib members, each rib member being substantially U-shaped in construction and including a pair of substantially parallel, spaced apart side wall portions, a bottom wall portion extending therebetween, and an end wall portion extending between said side wall portions and said bottom wall portion on at least one end portion of each of said elongated rib members;

(b) defining an aperture on at least one end wall portion of each of said elongated rib members, each of said apertures being sized and shaped so as to allow the neck and closure portions of each product container to pass therethrough when the product container is oriented at a particular orientation;

(c) defining an intermediate portion of each of the bottom wall portions of said elongated rib members, said intermediate portions being spaced from both side wall portions forming each respective rib member;

(d) forming the aperture as defined in step (b) above in each of the end wall portions associated with at least one end portion of each of said elongated rib members; and (e) removing the intermediate portion of each of said bottom wall portions forming said rib members such that the side wall portions and the remaining bottom wall portions of each respective rib member form spaced, opposed pairs of L-shaped members, each pair of opposed L-shaped members defining a channel therebetween adaptable for receiving the neck and closure portions of a row of product containers positioned therebetween, said remaining bottom wall portions defining rails adaptable for engaging and supporting at least an edge portion of the closure portion of each product container positioned within each respective channel for slidable movement therealong.

49. The method defined in claim 48 wherein said layered composite structure further includes a substantially planar member and a stiffening member, said substantially planar member being positioned between said at least one outwardly facing member and said stiffening member.

* * * * *

UNITED STATES PATENT AND TRADEMARK OFFICE

CERTIFICATE OF CORRECTION

PATENT NO. : 5,695,075

DATED : December 9, 1997

INVENTOR(S) : Paul L. Flum, Dewalt W. Fowler & Keith Harbour

It is certified that error appears in the above-identified patent and that said Letters Patent is hereby corrected as shown below:

Col. 4, line 29, "from" should be --front--.

Col. 8, line 16, after "is", insert --a--.

Col. 8, line 49, after "15B", insert --is--.

Col. 17, line 36, "mount" should be --amount--.

Col. 17, line 42, "trait" should be --unit--.

Col. 19, line 27, "fib" should be --rib--.

Col. 22, line 50, "from" should be --front--.

Col. 31, line 21, "mount" should be --amount--.

Signed and Sealed this

Third Day of March, 1998

Bruce Lehman

*Attest:*

BRUCE LEHMAN

*Attesting Officer*

*Commissioner of Patents and Trademarks*